US009850636B2

(12) United States Patent
Wu

(10) Patent No.: US 9,850,636 B2
(45) Date of Patent: Dec. 26, 2017

(54) RING-WING FLOATING PLATFORM

(71) Applicant: Zhirong Wu, Beijing (CN)

(72) Inventor: Zhirong Wu, Beijing (CN)

( * ) Notice: Subject to any disclaimer, the term of this patent is extended or adjusted under 35 U.S.C. 154(b) by 0 days.

(21) Appl. No.: 14/805,384

(22) Filed: Jul. 21, 2015

(65) Prior Publication Data

US 2015/0322640 A1 Nov. 12, 2015

Related U.S. Application Data

(63) Continuation of application No. PCT/CN2014/071121, filed on Jan. 22, 2014.

(30) Foreign Application Priority Data

Jan. 22, 2013 (WO) ..... PCT/CN2013/070808

(51) Int. Cl.
*B63B 35/44* (2006.01)
*E02B 17/02* (2006.01)
(Continued)

(52) U.S. Cl.
CPC ..... *E02B 17/02* (2013.01); *B63B 35/4413* (2013.01); *B65D 88/02* (2013.01); *E02B 17/0017* (2013.01); *E02B 17/025* (2013.01); *E02B 17/027* (2013.01); *E02B 17/06* (2013.01); *E02D 23/02* (2013.01); *E02D 23/10* (2013.01);
(Continued)

(58) Field of Classification Search
CPC ..... B63B 35/44; B63B 35/4413; E21B 43/01
See application file for complete search history.

(56) References Cited

U.S. PATENT DOCUMENTS 34,426 A * 2/1862 Howard ..... B63B 35/285 114/256
2,402,790 A * 6/1946 Vorenkamp ..... B65D 88/78 114/256
(Continued)

FOREIGN PATENT DOCUMENTS

CN 101032997 A 9/2007
CN 101666080 A 3/2010
(Continued)

OTHER PUBLICATIONS

International Search Report issued for PCT/CN2014/071121, dated Apr. 22, 2014.

*Primary Examiner* — Frederick L Lagman
(74) *Attorney, Agent, or Firm* — Norton Rose Fulbright US LLP

(57) ABSTRACT

A ring-wing floating platform is disclosed. The ring-wing floating platform includes a floating hull, a top of the floating hull being above a sea surface and its geometry at a water plane is centrally symmetric, a ring-wing surrounding a perimeter of a bottom of the floating hull with a horizontal projection of concentric annular geometries, a positioning system located at the bottom of the floating hull, and a topsides located above the floating hull and connected to the floating hull by deck legs or installed directly on the top of the floating hull. The axes of the ring-wing and the floating hull are collinear, and their bottoms are in a same horizontal plane. The ring-wing and the floating hull are connected together as a unitary structure by multiple connecting components with an annular gap in-between.

19 Claims, 16 Drawing Sheets

(51) Int. Cl.

| | |
|---|---|
| ***E02D 27/20*** | (2006.01) |
| ***E02D 23/02*** | (2006.01) |
| ***E02D 23/10*** | (2006.01) |
| ***E02D 25/00*** | (2006.01) |
| ***E02D 27/18*** | (2006.01) |
| ***E02D 27/52*** | (2006.01) |
| ***E02D 29/09*** | (2006.01) |
| ***E04H 7/02*** | (2006.01) |
| ***E02B 17/06*** | (2006.01) |
| ***B65D 88/02*** | (2006.01) |
| ***E04H 7/04*** | (2006.01) |
| ***E04H 7/18*** | (2006.01) |
| ***E02B 17/00*** | (2006.01) |
| ***E02D 27/12*** | (2006.01) |
| ***E02D 27/38*** | (2006.01) |
| ***E02D 29/00*** | (2006.01) |
| *B65D 88/78* | (2006.01) |

(52) U.S. Cl.

CPC ..... *E02D 25/00* (2013.01); *E02D 27/12* (2013.01); *E02D 27/18* (2013.01); *E02D 27/20* (2013.01); *E02D 27/38* (2013.01); *E02D 27/52* (2013.01); *E02D 27/525* (2013.01); *E02D 29/00* (2013.01); *E02D 29/06* (2013.01); *E04H 7/02* (2013.01); *E04H 7/04* (2013.01); *E04H 7/18* (2013.01); *B63B 35/44* (2013.01); *B63B 2035/442* (2013.01); *B63B 2035/448* (2013.01); *B65D 88/78* (2013.01); *E02B 2017/0039* (2013.01); *E02B 2017/0043* (2013.01); *E02B 2017/0056* (2013.01); *E02B 2017/0069* (2013.01); *F17C 2201/0104* (2013.01); *F17C 2201/054* (2013.01); *F17C 2203/0341* (2013.01); *F17C 2203/0362* (2013.01); *F17C 2203/0379* (2013.01); *F17C 2203/0631* (2013.01); *F17C 2203/0639* (2013.01); *F17C 2203/0678* (2013.01); *F17C 2205/0111* (2013.01); *F17C 2221/033* (2013.01); *F17C 2221/035* (2013.01); *F17C 2223/0153* (2013.01); *F17C 2223/0161* (2013.01); *F17C 2223/033* (2013.01)

(56) References Cited

U.S. PATENT DOCUMENTS 3,510,892 A * 5/1970 Monnereau ..... B63B 35/4413 114/264
3,550,385 A * 12/1970 Hill ..... E21B 15/02 114/257
3,709,307 A * 1/1973 Clark ..... E21B 43/01 114/264
3,766,583 A * 10/1973 Phelps ..... B63B 35/4413 114/256
3,921,558 A * 11/1975 Redshaw ..... B63B 35/4413 114/256
4,202,647 A * 5/1980 Lamy ..... B63B 9/065 405/14
4,234,270 A * 11/1980 Gjerde ..... B63B 9/065 405/202
4,295,758 A 10/1981 Yashima
4,498,412 A * 2/1985 Liden ..... B63B 35/4413 114/256
4,703,709 A * 11/1987 Behar ..... B63B 9/065 114/256
4,966,495 A * 10/1990 Goldman ..... B63B 21/502 114/264
5,609,442 A * 3/1997 Horton ..... B63B 9/065 405/196
5,791,819 A * 8/1998 Christiansen ..... B63B 9/065 114/265
6,244,785 B1 * 6/2001 Richter ..... B63B 3/04 114/125
6,340,272 B1 * 1/2002 Runge ..... B63B 9/065 114/256
6,408,780 B1 * 6/2002 Ozaki ..... E02B 3/064 114/264
6,786,679 B2 * 9/2004 Huang ..... B63B 1/048 114/264
7,114,884 B2 * 10/2006 Horne ..... B63B 35/4406 114/264
2002/0154954 A1 * 10/2002 Huang ..... B63B 1/048 405/200
2003/0024459 A1 * 2/2003 Davies ..... B63B 11/02 114/264
2003/0140838 A1 * 7/2003 Horton, III ..... B63B 9/065 114/264
2003/0152429 A1 * 8/2003 Mathis ..... B63B 21/502 405/224
2005/0039667 A1 * 2/2005 Otten ..... B63B 21/502 114/264
2010/0051624 A1 * 3/2010 Finn ..... B63B 27/24 220/560
2011/0013989 A1 * 1/2011 Wu ..... B65D 88/78 405/210
2013/0032075 A1 * 2/2013 Hannus ..... B63B 35/4406 114/264

FOREIGN PATENT DOCUMENTS

| | | | |
|---|---|---|---|
| CN | 201647096 | U | 11/2010 |
| CN | 101966868 | A | 2/2011 |
| WO | WO-97/29948 | A1 | 8/1997 |

* cited by examiner

RING-WING FLOATING PLATFORM

CROSS-REFERENCE TO RELATED APPLICATIONS

This patent application is a continuation of International Application Serial No. PCT/CN2014/071121 entitled "Ring-Wing Floating Platform," filed on Jan. 22, 2014, which claims the priority from International Application Serial No. PCT/CN2013/070808 entitled "Unitary Barrel of Steel Plate and Concrete Composite Structure, Unitary Group Barrel, and Offshore Platform," filed on Jan. 22, 2013. All of the above-identified applications are incorporated herein by reference in their entirety.

BACKGROUND

Field of the Invention

This invention relates to a ring-wing floating platform which has a dry wellhead and functions of drilling, production and storage. It can be used for oil and gas exploration, development and production.

Background of the Invention

Currently, the most common floating structures used for oil and gas field development and production in deep waters are four types: tension leg platform (TLP), spar, semi-submersible platform (SEMI) and floating production storage offloading unit or tanker (FPSO). The TLP and spar have the best hydrodynamic performance and drilling and production functions. They can be equipped with dry tree wellhead, yet they could not store oil. The hydrodynamic performance of SEMI is not as good as TLP and spar. It has functions for drilling and production. However, it could not be equipped with dry tree wellhead and doesn't have the function of storage typically. Ship-shaped FPSO has the worst hydrodynamic performance compared with the said three types. The greatest advantage of ship-shaped FPSO is it has functions of production and storage. However, it does not have drilling function and can't be equipped with dry tree wellhead. In addition, spar will have large heel under wind load considering its water plane area is small and draft is deep. SEVAN cylindrical FPSO, represented in U.S. Patent Document U.S. Pat. No. 6,945,736 B2, can be applied at sever sea states. Compared to traditional ship-shaped FPSO, its advantages are low cost and no requirement on single point mooring system. However, it has large heave motion and could not be equipped with dry tree wellhead.

Currently, a typical development plan for deep water oil field is: TLP or spar as wellhead platform (dry tree wellhead)+subsea pipeline+FPSO, or subsea wellhead+FPSO. Development of deep water gas field is slow and challenging, because the FPSO for production and storage of liquefied natural gas (LNG), called FLNG, is still in development stage, which can't produce and store LNG in harsh sea area. At present, the development usually adopts TLP or SPAR or subsea wellhead and relies on subsea pipelines to transport gases to shore directly, or to shallow water facilities first and then to shore. Gases would be liquefied in the shore base terminal and hauled away from seaports. In any way, plans using wellhead platforms or subsea wellheads, subsea pipelines and an FPSO or an onshore terminal for deep sea oil and gas field development would inevitably lead to complicated systems and facilities, high costs on engineering, construction, production, operation and field decommissioning.

Therefore, it is a major challenge of the offshore industry to replace the current development plan with a newly developed floating unit which has excellent hydrodynamic performance, storage capacities of crude oil, natural gas and LNG, and could be equipped with dry tree wellhead.

SUMMARY OF THE INVENTION

The goal of this application is to provide a ring-wing floating platform with excellent hydrodynamic performance, storage capacities of crude oil, natural gas and LNG, and could be equipped with dry tree wellheads. It can also be used as a deep water drilling platform for offshore exploration and development, prolonged test and trial production. Alternatively, it can also be used for deep water oil field development and production as a deep water floating platform with functions of drilling, dry tree wellhead, crude oil production and storage, to replace floating platforms and FPSO at one time. Also, it can be used for deep water gas field development and production as a deep water floating platform with functions of drilling, dry tree wellhead, LNG production and storage. Additionally, it can be used as a deep water floating platform with the combinations of multiple functions mentioned above.

In order to achieve the goal mentioned above, this application proposes a ring-wing floating platform, which includes:

A floating hull (hull for short), wherein its top is above a sea surface and its water plane section is centrally symmetric, such as a circle or an regular polygon, or multiple circles being tangent to each other in a single or multiple layers, or four-circle or four-square distributed in an equal distance. A ring-wing, wherein it is set at the perimeter of the bottom of the hull with sufficient large dimensions including fixed integral ring-wing and segmented ring-wing. The horizontal projection of the ring-wing is a shape with concentric inner and outer annulus. The ring-wing and the hull have a same concentric central axis and their bottoms are in a same horizontal plane. An annular gap along the radial direction exists in-between. Through multiple connecting components, the hull and the ring-wing form a unitary structure. A positioning system, wherein it is located at the bottom or middle of the hull. A topsides above or on the top of the hull, wherein it is connected to the hull top by deck legs or installed on the hull top directly. It is characterized that: the water plane area of the hull is larger than SPAR's, and the top of the ring-wing is located in a certain depth below waterline where waves have little effect; the size of the annular gap between the ring wing and the hull, and the size of the ring wing, such as its radial height and width of the section, has to be determined by hydrodynamic calculations and model test.

As a specific implementation plan of the ring-wing floating platform, this application further provides with a floating wellhead storage offloading (FWSO) and a floating drilling platform, including but not limited to: 1) a single-cylinder FWSO, wherein its hull is a floating single-cylindrical-tank, which water plane section is a circle or a regular polygon; 2) a multi-cylinder FWSO, wherein its hull is a floating multi-cylindrical-tank, wherein the section of the floating multi-cylindrical-tank at water plane is centrally symmetric geometry containing multiple circles. These circles are tangent to each other in a single or multiple layers; 3) a multi-cylinder drilling platform, its hull is a floating multi-cylindrical-tank, which section at water plane is centrally symmetric geometry containing multiple circles. These circles are tangent to each other in a single or multiple layers; 4) a ring-wing semi-submersible platform, wherein the section of the ring-wing semi-submersible platform at water plane includes four-circle or four-square distributed in an equal distance.

This application also provides a ring-wing floating platform including a floating hull, a top of the floating hull being above a sea surface and its geometry at a water plane is centrally symmetric, a ring-wing surrounding a perimeter of a bottom of the floating hull with a horizontal projection of concentric annular geometries, the ring-wing being a segmented ring-wing, one or more segments of the segmented ring-wing being one or more of: a fixed ring-wing segment, a tieback ring-wing segment, or a rotatable and foldable ring-wing segment, a positioning system located at the bottom of the floating hull, and a topsides located above the floating hull and connected to the floating hull by deck legs or installed directly on the top of the floating hull. The axes of the ring-wing and the floating hull are collinear, and their bottoms are in a same horizontal plane. The ring-wing and the floating hull are connected together as a unitary structure by multiple connecting components with an annular gap in-between.

Compared with the available technologies, the present application has the following features and advantages:

1. Compared with the existing floating platform and FPSO, this ring-wing floating platform adopts their main advantages. Its hydrodynamic performance is comparable to, or even better than SPAR platform. It has drilling function and could be installed dry wellheads. It is also similar to FPSO with functions of production and liquid storage. Especially, it has the functions of LNG production, storage and vaporization, which current FPSO can't achieve.
2. This ring-wing floating platform shows functions of oil and gas exploration, development and production in deep waters and harsh sea conditions with a series of advantages: eco-friendly, safe, reliable, flexible, and easy to remove. All the construction and commissioning work of the entire platform can be completed in shipyard, which significantly reduces construction costs, production operation costs, and decommissioning costs.

BRIEF DESCRIPTION OF THE DRAWINGS

These drawings described herein are only used for the purpose of interpretation and do not intend to limit the scope of the present disclosure of the invention in any way. Further, the shape and dimensions of each component in the graphs are only schematic to help readers understand the invention, not specifically defining shape and size of this invention. Engineers in this field could customize shapes and dimensions to implement the invention, by considering the guidance in this invention and local realistic situation.

Description of appended drawing reference numbers is as follow:

1. Ring-Wing Floating Platform, 10. Floating Hull, 11. Floating Single-Cylindrical-Tank, 111. Annular Bulkhead, 112. Radial Bulkhead, 113. Storage Compartment, 114. Seawater Ballast Compartment, 12. Floating Closely Connected Multi-Cylindrical-Tank, 13. Floating Interval-Connected Multi-Cylindrical-Tank, 131. Floating Pillar Tank, 132. Bottom Horizontal Connection Girder, 14. Moon Pool, 20. Ring-Wing, 21. Ring-Wing with Inverted U-Shaped Cross Section, 22. Integral Ring-Wing, 23. Fixed Ring-Wing Segment, 24. Tieback Ring-Wing Segment, 25. Rotatable and foldable Ring-Wing Segment, 251. Horizontal Plate, 252. Vertical Plate, 26. Notches, 27. Connection Seam, 28. Hinge, 29. Annular Gap, 30. Positioning System, 31. Mooring Leg System, 32. Fairlead of Mooring Leg, 40. Topsides, 41. Open Deck, 411. Deck Leg, 42. Watertight Box Deck, 5. Water Surface, 60. Connecting Components between Ring-Wing and Floating Hull, 61. Fixed Connection Brackets, 62. Butt-Joint Structure, 621. T-Shaped Sliding Slot, 622. T-Shaped Sliding Brackets, 623. Guide Hole, 624. Guide Pulley, 63. Rotatable and Foldable Mechanism, 631. Articulated Connecting Rod, 632. Fixed Hinge Bearing, 633. Sliding Hinge Bearing, 634. Sliding Slot, 64. Site-Connected Clamping Plate; 70. Multi-Cylinder Floater, 71. Tank Unit with Single Wall, 72. Tank Unit with Steel Plate and Concrete Composite Walls, 721. Outer Concrete Tank, 7211. Outer Concrete Tank Shell, 7212. Outer Concrete Tank Head, 7213. Ring Corbel, 722. Inner Steel Tank, 7221. Inner Steel Tank Shell, 7222. Inner Steel Tank Head, 7223. Epitaxial Shell of Inner Steel Tank, 7224. LNG Inner Compartment, 7225. Thermal Insulation Layer, 7226. Outside Steel Layer of Inner Steel Tank, 723. Isolation Layer, 724. Spare Compartment, 73. Flat Cylinder or Ring, 74. Conical Guide Surface.

DETAILED DESCRIPTION OF THE INVENTION

Drawings and descriptions of embodiments can make the invention details clearer. However, those described embodiments are only used to explain the purpose of the invention, and could not be interpreted as limiting the invention by any means. Engineers in this field, under the guidance of the invention, could conceive any possible deformation based on the invention, which should be considered as belongs to the scope of the invention.

This application provides a ring-wing floating platform 1, called as Ring Wing Platforms (RWP), which can be used for drilling, oil and gas production, natural gas liquefaction and regasification, chemical products and liquids storage, and oily water treatment for the exploration, development and production of deep water oil and gas fields.

Figure 1:
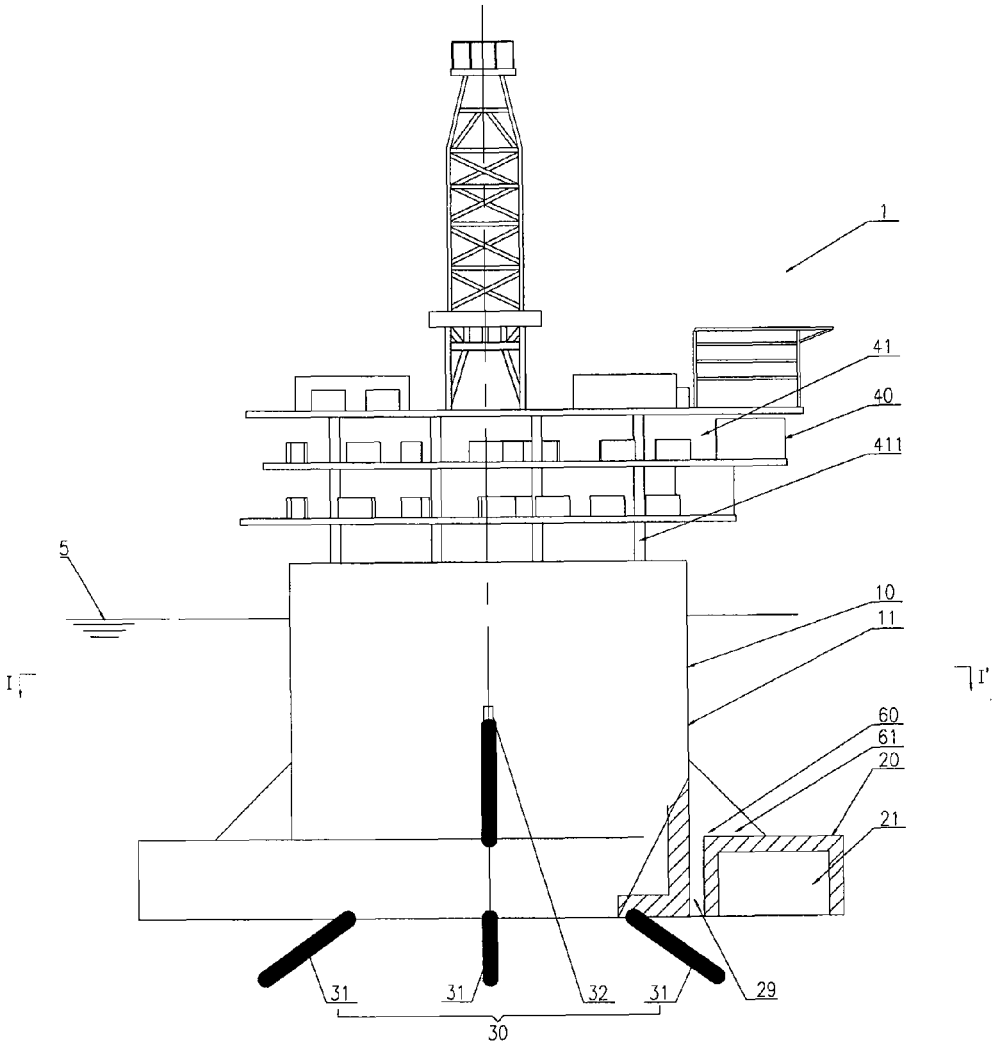
FIG. 1 is a front view of the ring-wing floating platform.
Figure 3:
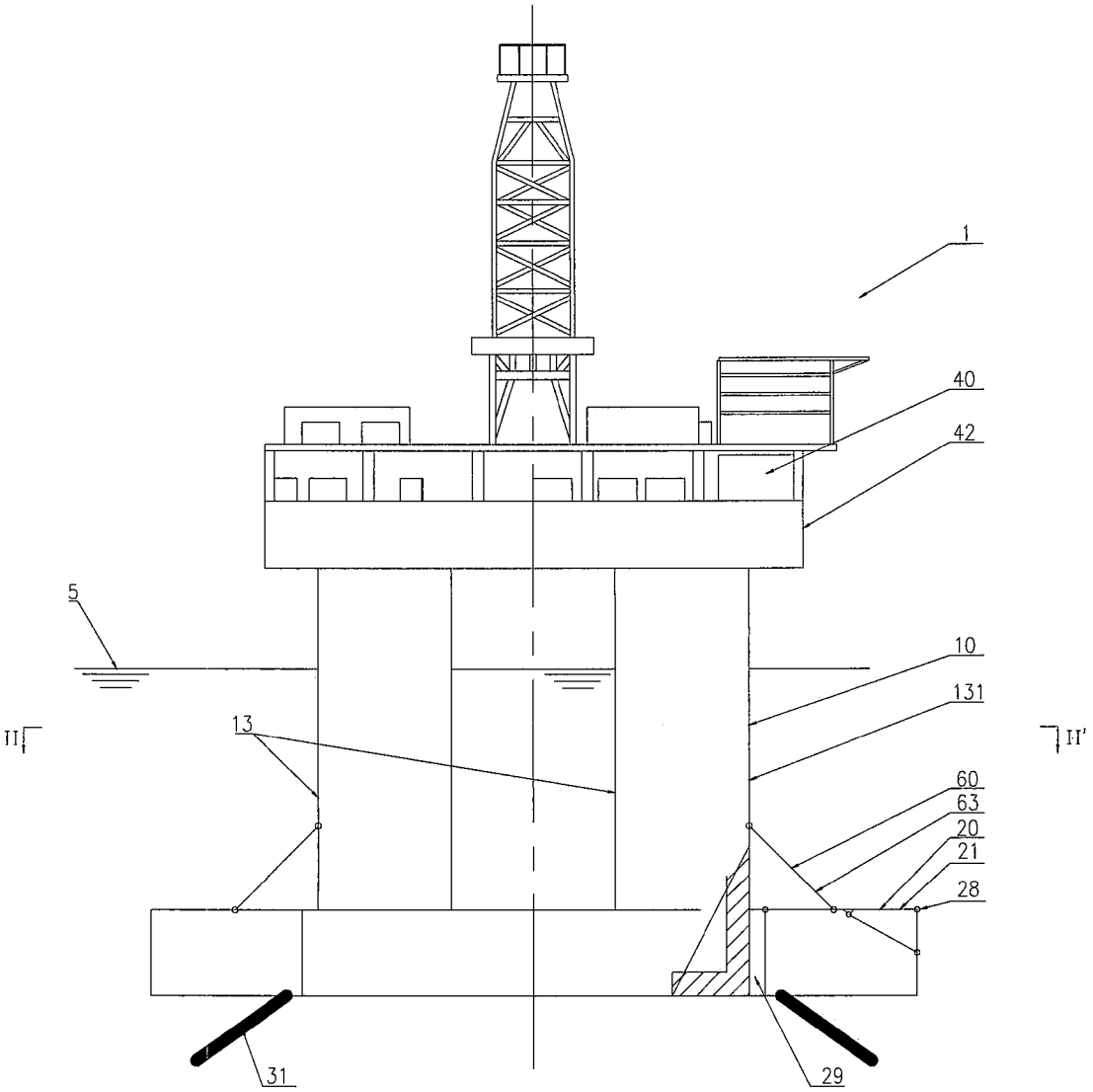
FIG. 3 is a front view of the ring-wing semi-submersible platform.

As shown in FIG. 1 and FIG. 3, this ring-wing floating platform 1 comprises a floating hull 10, a ring-wing 20, a positioning system 30 and a topsides 40.

Figure 4:
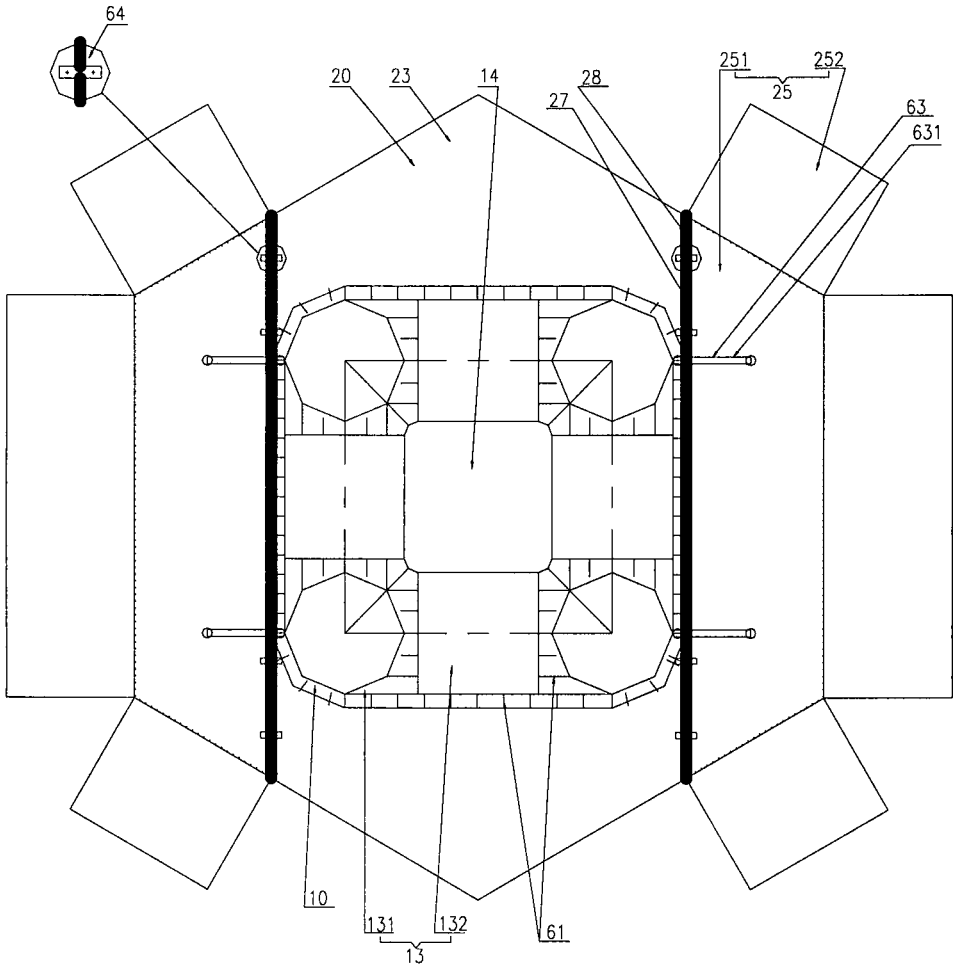
FIG. 4 is a sectional view of FIG. 3 from II-II' axis, Option A (the cross section of vertical pillar tank is a circular, the cross section of annular gap is a square)
Figure 5:
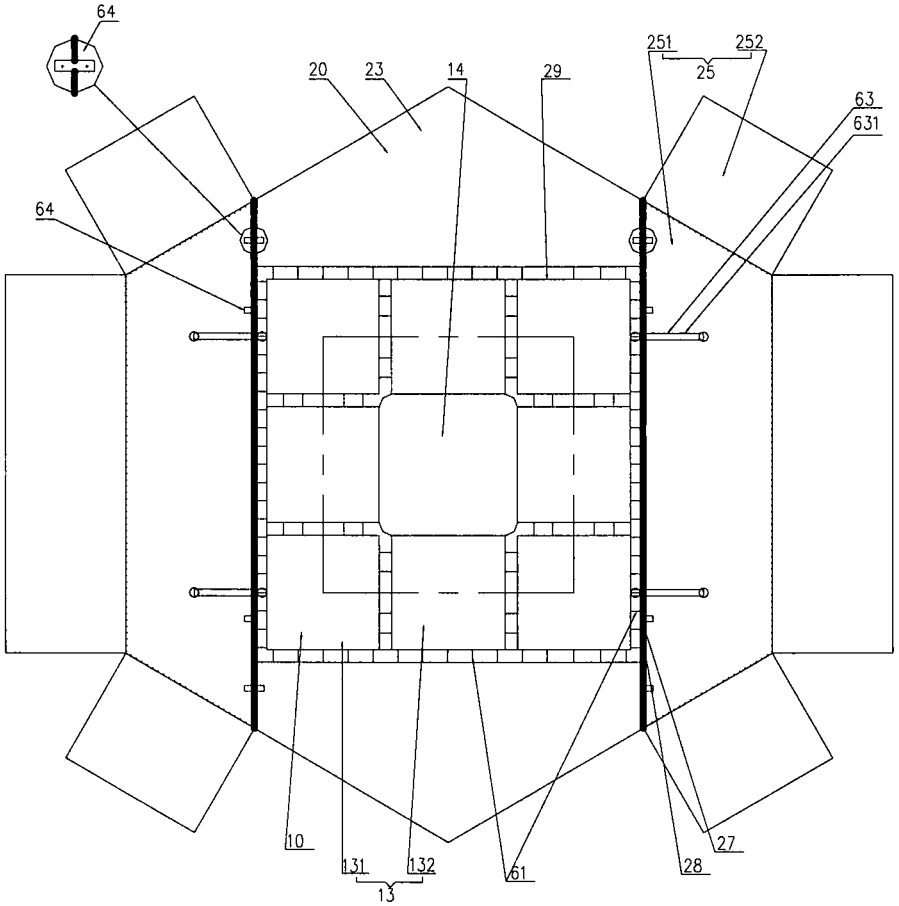
FIG. 5 is a sectional view of FIG. 3 from II-II' axis, Option B (the cross section of vertical pillar tank is a square, the cross section of annular gap is a square)
Figure 6:
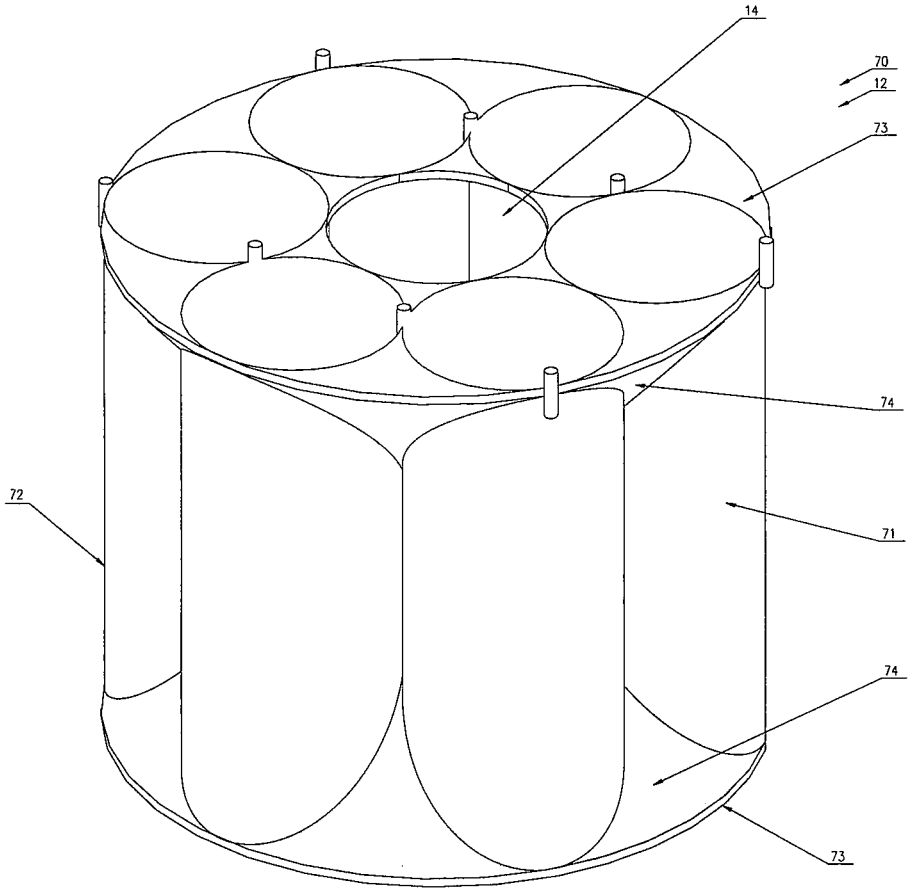
FIG. 6 is an isometric view of the floating multi-cylindrical-tank.
Figure 7:
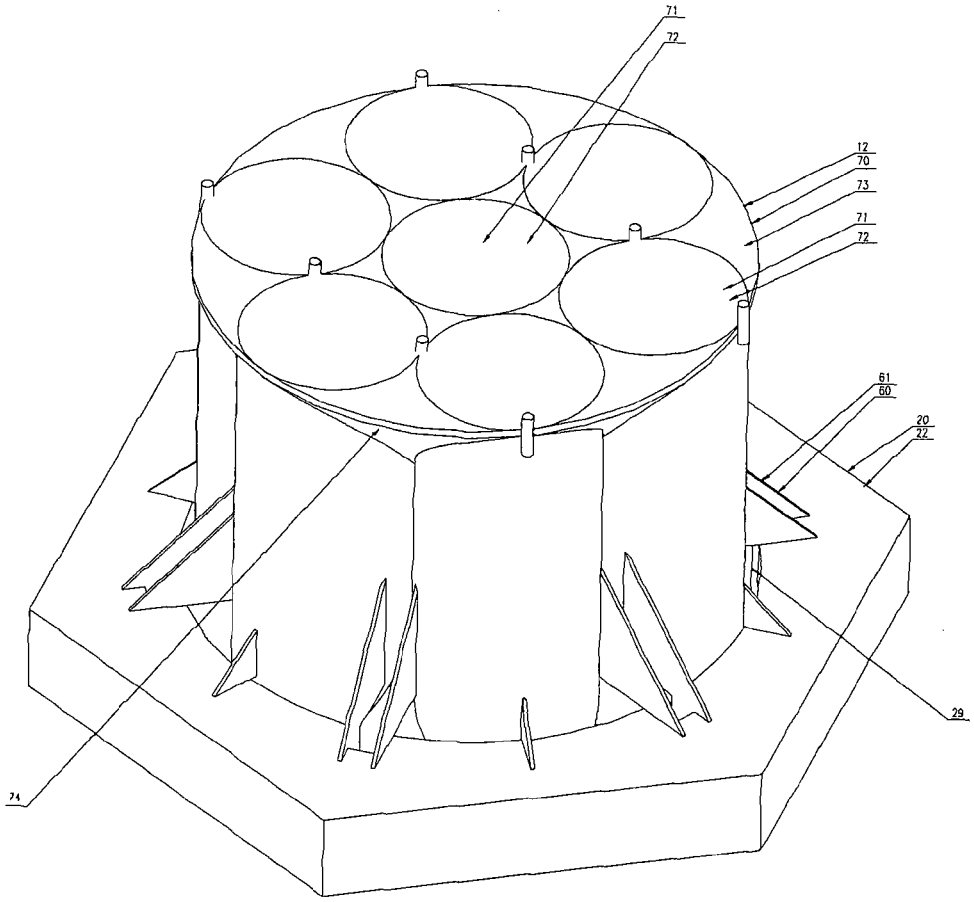
FIG. 7 is an isometric view of the floating multi-cylindrical-tank with an integral ring wing.

In this embodiment, the top of the floating hull 10 is above the sea surface 5. The cross section of the floating hull 10 at water plane is a centrally symmetric graph, such as a circle (see FIG. 2), or a regular polygon, or four circles in equidistant distribution (see FIG. 4 and FIG. 15), or four squares in equidistant distribution (see FIG. 5 and FIG. 16), or multiple circles tangent to each other as shown in FIG. 6 and FIG. 7. The ring-wing 20 including fixed integral and segmented types is attached around the perimeter of the bottom of the floating hull 10. The ring-wing 20 and the floating hull 10 has a same concentric central axis and their bottoms are in a same horizontal plane. An annular gap or four annular gaps 29 along the radial direction exists in-between the floating hull 10 and the ring-wing 20, which acts a channel to link the water above and below the ring-wing. Horizontal projections of the ring-wing 20 are annular geometries with a same centroid; wherein the outer geometrical figure is an outer circle (see FIG. 2) or a regular polygon (see FIGS. 4, 5, 7, 15 and 16), the inner geometrical figure is an inner circle (see FIG. 2, 7) or a regular polygon (a square as example, shown in FIG. 4 and FIG. 5) or a similar center-symmetrical geometrical figure to the figure of the multi-interval water planes of the floating hull 10 (a four-circle or a four-square in equidistant distribution as shown in FIG. 4 and FIG. 5 respectively). By multiple connecting components 60, the ring-wing 20 and the floating hull 10 could form a unitary structure. The connecting components 60 comprise fixed connection bracket 61, butt connection mechanism 62, rotatable and foldable mechanism 63, and site-connected clamping plate 64. The positioning system 30 is located at the lower part of the floating hull 10, which could be a mooring leg system 31 or a dynamic positioning system or both. The mooring leg system 31 is a catenary mooring system or a semi-taut system or a taut system. The topsides 40 has two types of decks: open deck, and watertight box deck used in the ring-wing semi-submersible platform. The topsides 40 is located above the top of the floating hull 10. The Open deck 41 is connected to the floating hull 10 by deck legs 411, or installed directly on the top of the floating hull 10 (not shown in figures).

Figure 15:
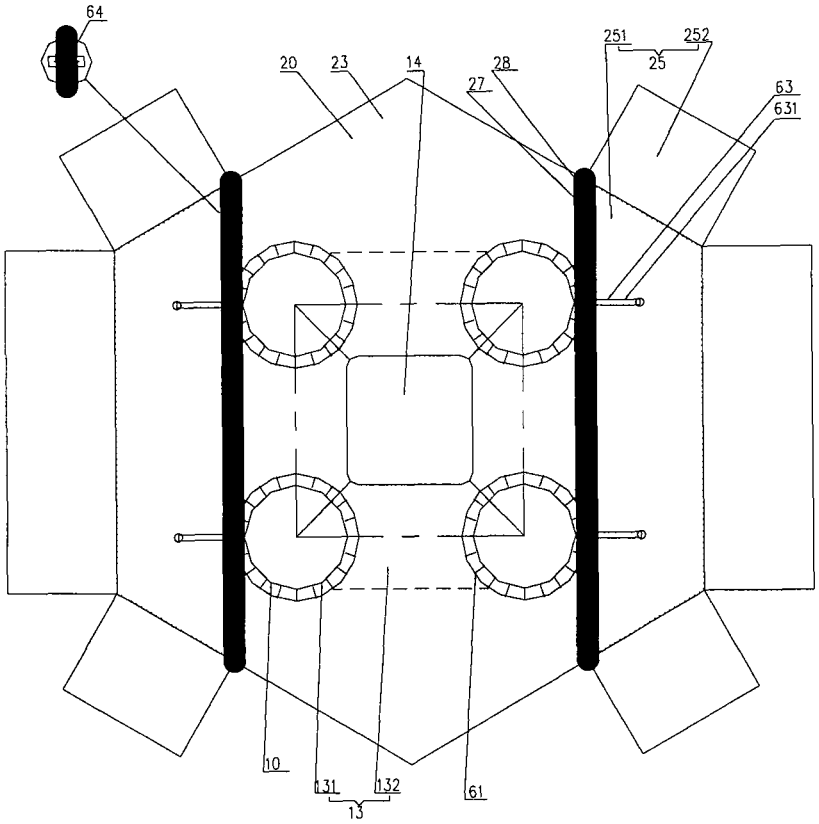
FIG. 15 is a sectional view of II-II' axis in FIG. 3 (an unfolded plane, the cross section of vertical pillar tank is a circular, the number of annular gaps is four)

The floating hull 10 provides all or most of the buoyancy required for the entire platform, supports for the topsides 40, as well as capacity of storing liquid if needed. The floating hull 10 has two forms: floating single-cylindrical-tank 11 (see FIG. 1), and floating multi-cylindrical-tank, which are being connected closely (see FIGS. 6 and 7) or having intervals between tanks (see FIGS. 3, 4, 5, 15 and 16). The cross section of the floating single-cylindrical-tank 11 is a circle (see FIG. 2) or an equilateral polygon. The cross section of the floating multi-cylindrical-tank at water plane is a centrally symmetric geometry, such as four circles in equidistant distribution shown in FIG. 4 and FIG. 15, four squares in equidistant distribution shown in FIG. 5 and FIG. 16, and multiple circles tangent to each other as shown in FIG. 6 and FIG. 7. The water plane area of the floating hull 10 is larger than SPAR. The top of the ring-wing 20 is located below the waterline where waves have little effects. Hydrodynamic analyses and calculations of the floating platform have to be carried out to determine the size of the annular gap(s) 29 between the ring-wing 20 and the floating hull 10, and the height and width of the radial cross section of the ring-wing 20. A moon pool 14, used to place waterproof casings and risers required for drilling and dry wellhead, may or may not exit in the center of the floating hull 10. FIGS. 6 & 7 show the floating multi-cylindrical-tank with each tank being connected closely (called as floating closely connected multi-cylindrical-tank 12), and its cross section at water plane is centrally symmetric geometry, consisting of six tangential circles in single layer as shown in FIG. 6, or in multiple circles in multiple layers. A moon pool 14 would be located in the center as shown in FIG. 6, but no moon pool in the center of the floating hull as shown in FIG. 7. As shown in FIGS. 3, 4, 5, 15 and 16, a type of the floating multi-cylindrical-tank, called as floating interval-connected multi-cylindrical-tank 13 form by four pillar tanks, could be used for the ring-wing semi-submersible platform. The cross section of the said interval-connected multi-cylindrical-tank 13 at water plane is a centrally symmetric geometry, which consists of four circles with centers at the four corners of a square separately (as shown in FIG. 4 and FIG. 15), or four squares with centroids at the four corners of a square separately (see FIG. 5 and FIG. 16). The said pillar tanks can serve as one or multiple following functions as needed: storage compartment, seawater ballast compartment, engine room, pump room, spare empty compartment and work room.

The floating hull 10 is a steel structure or a concrete structure or a composite structure combined with both. The concrete structure comprises reinforced concrete structure, bi-steel concrete structure, fiber concrete structure and other existing concrete structures. During the storage and transportation processes, stored liquids in the floating hull 10 with liquid storage function can be displaced with ballast seawater in an equal or unequal mass flow rate, and the equal mass flow rate process is preferable. If the stored liquid is crude oil or liquids at normal temperature, the "displacement process between stored liquid and ballast water in an equal mass flow rate in a closed, gas-pressurized and inter-connected system" as described in U.S. Pat. No. 8,292,546 B2 is recommended. If the stored liquid is LNG or LPG, the "displacement process between LNG or LPG and ballast water in an equal mass flow rate" as described in U.S. Pat. No. 8,678,711 B2 is recommended. U.S. Pat. Nos. 8,292,546 B2 and 8,678,711 B2 are incorporated herein by reference.

Figure 2:
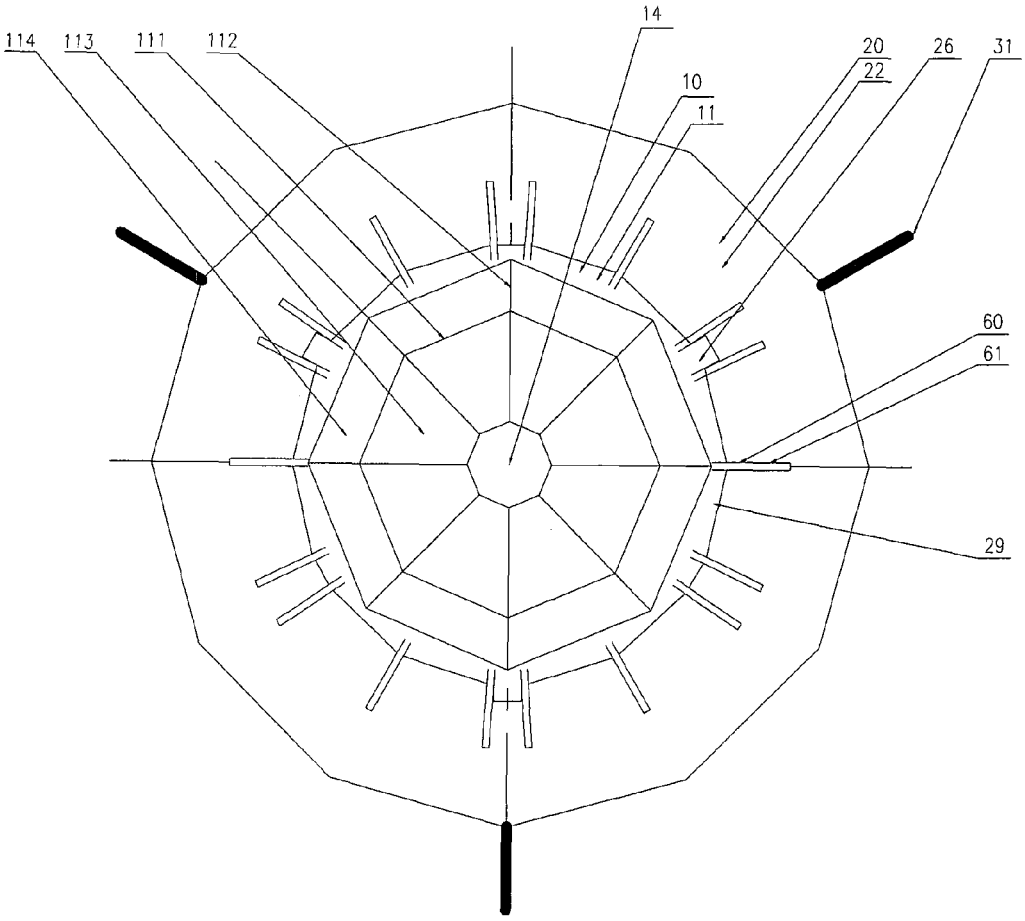
FIG. 2 is a sectional view of FIG. 1 from I-I' axis.

FIGS. 1 and 2 show a floating single-cylindrical-tank 11 with a circle or regular polygon shaped cylindrical outer shell, which is preferably made of steel structure. As shown in FIG. 2, the floating hull 10 has, besides the outer shell, a top plate, a double-bottom and two layers of annular vertical bulkheads 111 in a hexagon or circular or regular polygon shape from the outer shell to the centroid, which forms two of outer and middle annular compartments and an inner (center) compartment with several vertical bulkheads 112 along the radial direction being placed in the middle and the outer compartments. The center compartment could be as pump room or moon pool 14, the middle compartments could be storage compartments 113, the outer compartments and the compartments inside the double-bottom could be seawater ballast compartments 114 or/and solid ballast compartments. The floating single-cylindrical-tank 11 can be used in a ring-wing floating production platform with storage function and dry wellhead, which could substitute existing SPAR and FPSO at same time. The said displacement process could be used for the said platform and the equal mass flow rate process is preferred. Iron sand is used in the solid ballast compartments to balance additional buoyancy of platform caused by the equal mass flow rate displacement process.

FIG. 6 shows a floating closely connected multi-cylindrical-tank 12, also called as multi-cylinder floater 70, which comprises a main body and two associated round connection structures at its bottom and top. The main body comprises multiple tank units being closely arranged in concentric circles with one or more layers to form a honeycomb naming multi-cylinder tank group; wherein the tank unit is one with single wall 71 or one with steel plate and concrete composite walls 72. A tank unit could be set at the center of the said tank group (see FIG. 7). The tank unit at the center of the tank group could also be removed to form a moon pool 14 being penetrative from the top to the bottom (see FIG. 6). Some or all tank units of the tank group could be used to store liquids to become storage tank units, or alternatively, could serve as buoyancy compartment, or machine/pumps room or working space instead of storage. The storage tank units could be used to store one or kinds of several different liquids separately. The top and bottom of outer walls of the tank units of the main body are extended outward to form a top and a bottom connection structure separately called as flat cylinder 73. The diameter of the flat cylinder 73 is equal to the diameter of the circumscribed circle projected by outer tank units. For the tank group with a moon pool 14, its flat cylinder 71 has a hole at the center, which diameter is equal to the inscribed circle diameter of the inner layer tank units. The bottom of the top flat cylinder and the top of the bottom flat cylinder protuberates up and down respectively along the vertical direction to form two conical surfaces 74 for diversion. Each conical surface 74 reaches and links with the outer tank units of the said tank group to produce intersecting lines. The one-side cone angle of the conical surface 74 is not greater than 45 degrees. As a result, the vertical wave forces caused by diffractions of water particles could be reduced.

In this embodiment, the multi-cylinder floater 70 contains four types of tank units: 1) reinforced concrete or steel tank unit with single wall 71, 2) tank unit with steel plate and concrete composite walls 72, 3) vertical cylindrical tank group as described in U.S. Pat. No. 8,292,546 B, 4) vertical tank unit with steel plate and concrete composite walls as described in International Application Serial No. PCT/CN2013/070808 proposed in Jan. 22, 2013.

The tank units with single wall 71 formed multi-cylinder floater 70 is mainly used for drilling platforms, the tanks unit could be as the following one or multiple function spaces: storage compartment, seawater ballast compartment, machine/pump room, spare empty compartment, and work room. The storage compartment is used to store liquids required for drilling and well liquids produced by logging and trial production. The tank units can also be as sedimentation compartments of the production platform to deal with oily water by thermochemical settlement or bacterial biochemical treatment.

Figure 8:
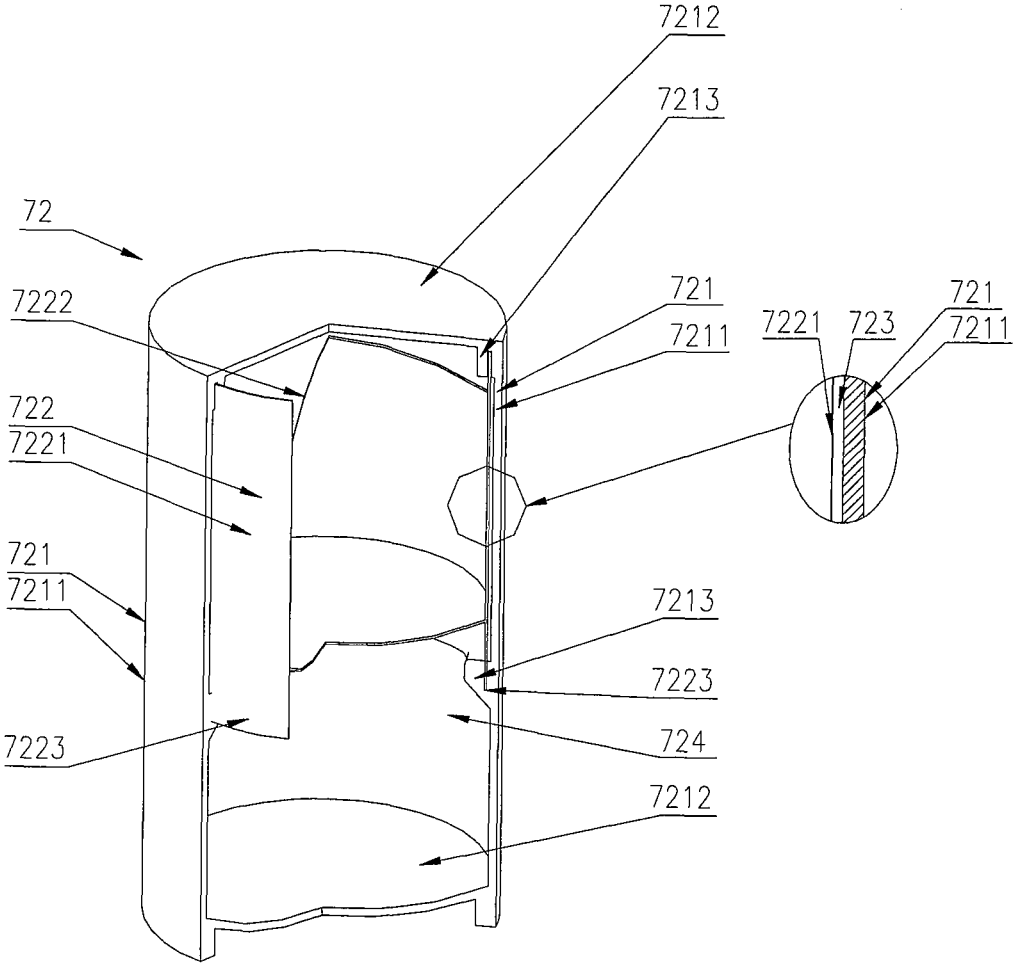
FIG. 8 is an isometric view of the tank unit with steel plate and concrete composite walls that can be used to store crude oil and LPG.
Figure 9:
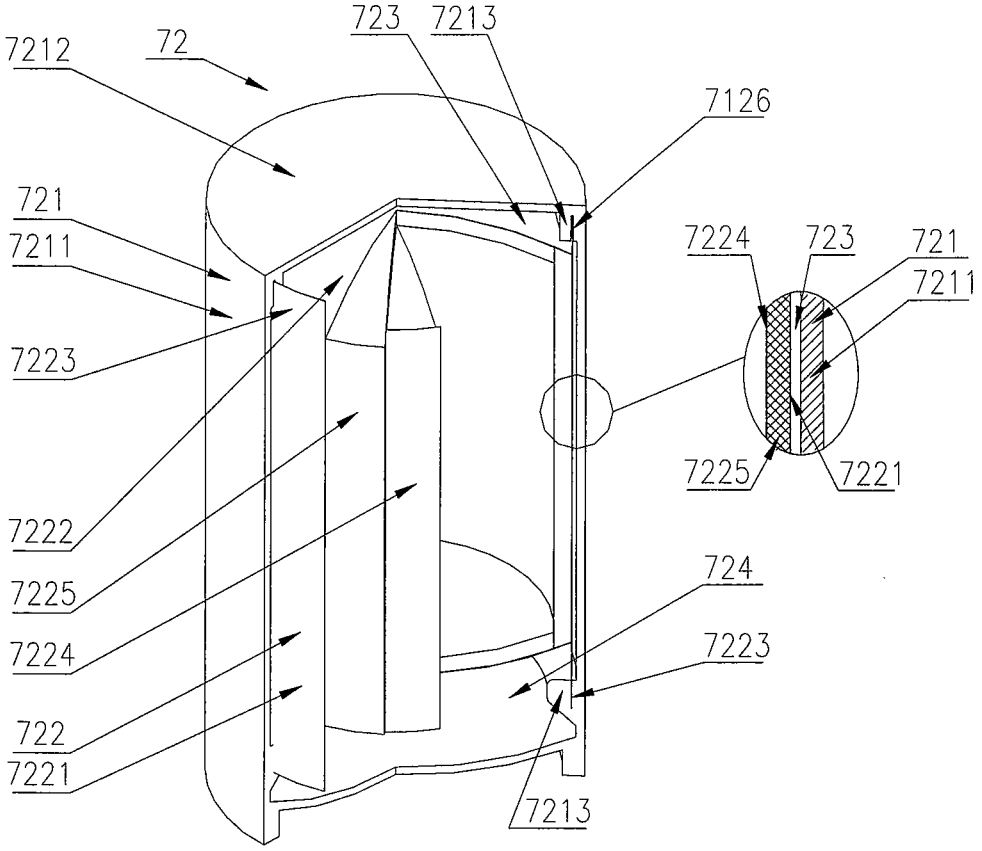
FIG. 9 is an isometric view of the tank unit with steel plate and concrete composite walls that can be used to store LNG.

As shown in FIGS. 8 and 9, the tank unit 72 with steel plate and concrete composite walls is mainly used for floating production platforms, and can be used to store crude oil, oily water, LPG, LNG and other liquid products. As shown in FIG. 8, the tank unit 72 with steel plate and concrete composite walls contains: 1) a cylindrical outer concrete tank 721, including an outer tank shell 7211, two outer tank heads 7212 at both ends and two ring corbels 7213 in the inner side of the outer tank shell 7211, wherein one of the two ring corbels 7213 is on the top of the outer tank and the other one is at the bottom, or both ones are arranged in the middle with an interval, or one is on the top and the other one is in the middle position; 2) a cylindrical inner steel tank 722, including an inner tank shell 7221, two inner tank heads 7222 and two epitaxial shells 7223 being connected to the two ring corbels 7213 respectively, wherein both two epitaxial shell connections are fixed connections, or one is fixed connection and the other is sliding connection. Except for the said connections, the outer tank and the inner tank will not contact to each other to form gaps or spaces in-between; 3) the gap between the outer tank shell 7221 and the inner tank shell 7211, and the smaller spaces between the adjacent outer tank head 7212 and inner tank head 7222 form isolation layers 723, which is filled with an isolated medium. The relatively large space between the adjacent outer tank head 7212 and inner tank head 7222 could serve as a spare compartment 724. The outer concrete tank 721, the inner steel tank 722, the isolation layer 723 and the spare compartment 724 would become an integrated tank unit 72.

The seawater ballast compartment inside the tank unit 72 in this embodiment is the concrete spare compartment. Therefore, the tank unit with steel plate and concrete composite walls 72 in this embodiment could save steel. However, the pressure inside the tank unit 72 should not be too high, usually 1~2 bar above atmospheric pressure.

As shown in FIG. 8, the tank unit with steel plate and concrete composite walls 72 is used to store crude oil, or liquids at normal pressure and temperature. Wherein the inner steel tank 722 with single wall is as liquid storage compartment located at an upper position inside the outer concrete tank 721 (see FIG. 8) or at a middle position (not shown in figures). The isolation layer 723 between the outer concrete tank 721 and inner steel tank 722 is filled with a nitrogen, the spare compartments 724 at the bottom and/or the top of the inner steel tank 722 and outer concrete tank 721 could be used as seawater ballast compartments. During operation of the platform, the stored liquid can be displaced with the ballast seawater in an equal or unequal mass flow rate and the equal mass flow rate process in a closed, gas-pressurized and inter-connected system is recommended.

As shown in FIG. 9, the tank unit with steel plate and concrete composite walls 72 is used to store liquefied natural gas or liquids at ultralow temperature. Wherein the inner steel tank 722 is as liquid storage compartment with multi-wall 722 located at an upper position inside the outer concrete tank 721, or at a middle position; the multi-wall contains, from inside to outside, steel plates 7224 with ultra-low temperature resistance and low coefficient of linear expansion, thermal insulation layer 7225 and outer steel plate (outside steel layer of the inner steel tank with multi-wall 7221). The isolation layer 723 between the outer concrete tank 721 and inner steel tank 722 is filled with a nitrogen, and the spare compartments 724 at the bottom and/or the top of the inner steel tank 722 and outer concrete tank 721 can be used as seawater ballast compartment. During operation of the platform, the stored liquid can be displaced with ballast seawater in an equal or unequal mass flow rate and the equal mass flow rate process is recommended.

As shown in FIG. 8, the tank unit with steel plate and concrete composite walls 72 is used to store liquefied petroleum gas (LPG) or pressurized liquid at normal temperature. Wherein the inner steel tank 722 is as liquid storage compartment with single wall located at an upper position inside the outer concrete tank 721, or at a middle position.

The top/bottom epitaxial shell of inner steel tank 7223 is connected to the top and middle ring corbels 7213 through sliding and fixed connections respectively. The isolation layer 723 between the outer concrete tank 721 and inner steel tank 722 is filled with a nitrogen, and the spare compartments 724 at the bottom and/or the top of the inner steel tank 722 and outer concrete tank 721 can be used as seawater ballast compartment. During operation of the platform, the stored liquid can be displaced with ballast seawater in an equal or unequal mass flow rate and the equal mass flow rate process is recommended.

In order to achieve transmission of crude oil or condensate etc., two sets or evenly distributed three sets of fan-shaped rotated single point mooring/offloading system are used for the ring-wing floating platform 1, and each set comprises a mooring winch and a floating hose drum, which are installed on the two sides of the top of the floating hull 10 or the lower deck of the topsides 40. A conventional shuttle tanker could be tied through the fairlead on the floating hull 10 via a mooring hawser. The shuttle tank will rotate with the center of the fairlead within a 240° sector under weathervane effect by the wind, current and wave, if the hawser keeping tension. In case the rotation of the shuttle tank beyond the 240°, the shuttle tanker has to be disconnected. The floating hose of the drum is used to transport the stored liquid from the ring-wing floating platform 1 to the shuttle tanker. The mooring winch can be cancelled if shuttle tanker with DP system. Transmission of LNG or LPG shall be used side-by-side offloading system (not shown in Figures).

FIG. 3 shows a type of floating interval-connected multi-cylindrical-tank 13—four-column floater, which is used for the ring-wing semi-submersible platform only. The four-column floater comprises: four floating pillar tanks 131 and four bottom horizontal connection girder 132. The cross section of each pillar tank 131 is a circle (see FIGS. 4, 15) or a rectangle (see FIGS. 5, 16), which center or centroid is located at one of the four corners of a square. Each horizontal connection girder 132 connects to the bottoms of two adjacent pillar tanks 131, which center line is at an edge of the square. The cross section of the said girder 132 is closed box-shaped or H-shaped or double H-shaped with a width equal to the diameters of the circular pillar tank 131 or the side length of the rectangular pillar tank 131. The height of the cross section of the said girder 132 is determined by the strength and stiffness requirement of the structure. The bottom of the horizontal girder 132 is at the same horizontal plane as the bottom of the pillar tank 131. The horizontal girder 132 is connected to the pillar tank 131 through multiple fixed connection brackets 61 with gap(s) 29 designed as water channel(s).

So, the four pillar tanks 131, the watertight box deck 42 on the top, and the four horizontal girders 132 at the bottom become the main structure frame of the platform. The advantage of the horizontal connection girders with a box-shaped cross section is they can provide buoyancy during construction and wet tow, which is significant to the concrete platform with a heavy self-weight. However, its disadvantage is completed structures. A concrete structure is the preferred selection for circular pillar tanks and a steel structure for rectangular pillar tanks. The four horizontal girders 132 and the fixed connecting brackets 61 can be concrete structures or steel structures. Anyone or combinations of storage compartment, seawater ballast compartment, engine room, pump room, spare empty compartment and work room, can be placed in each of the pillar tanks 131. The said storage compartment would be used to collect liquids needed for drilling and well liquids from logging and trail production activities.

Figure 16:
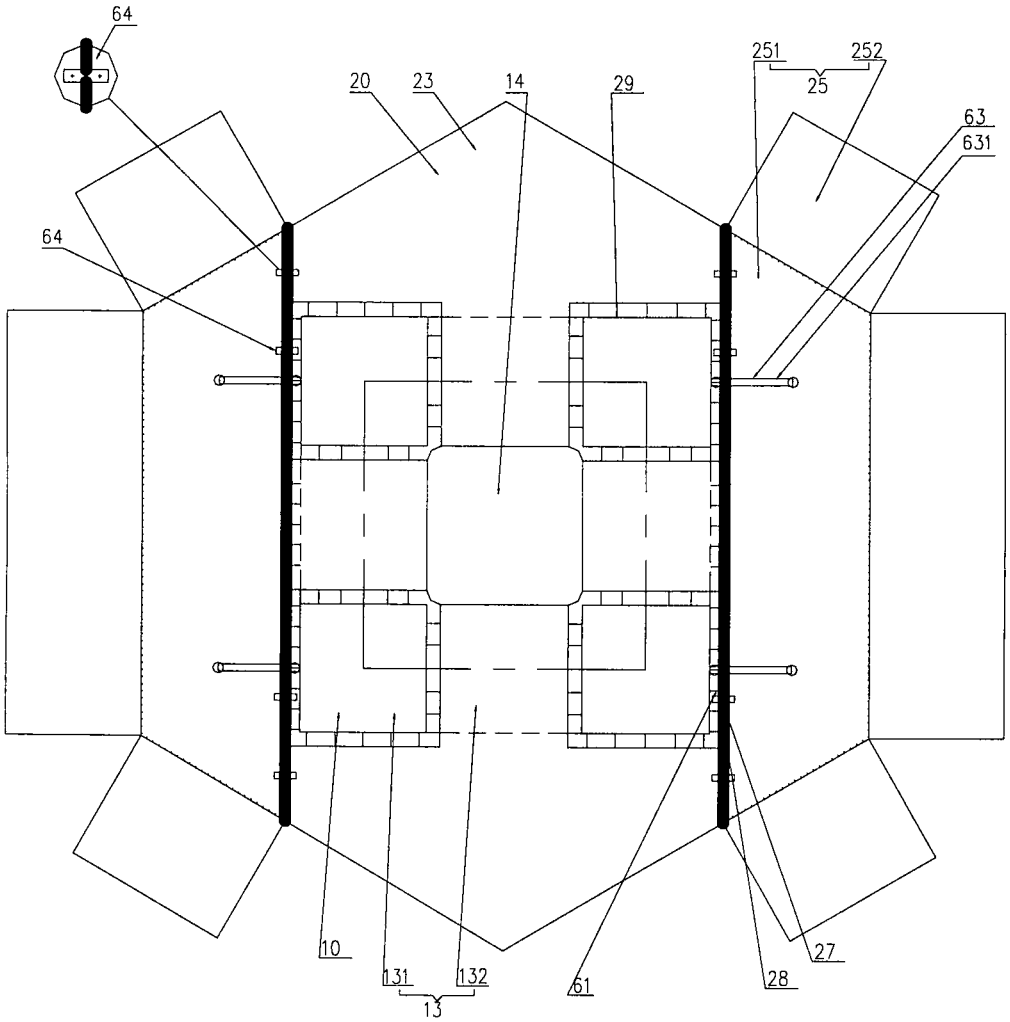
FIG. 16 is a sectional view of II-II' axis in FIG. 3 (an unfolded plane, the cross section of vertical pillar tank is a square, the number of annular gaps is four)

As described above, horizontal projections of the ring-wing 20 are annular geometries with a same centroid. The outer shape is an outer circle (see FIG. 2) or a regular polygon (see regular hexagon in FIGS. 4, 5, 7, 15 and 16), the inner shape is an inner circle (see FIGS. 2 and 7) or a regular polygon (the square shown in FIGS. 4 and 5) or several similar center-symmetrical geometrical figures to the figures of the multi-interval water planes of the floating hull (a four-circle or a four-square in equidistant distribution as shown in FIGS. 15 and 16 respectively). The ring-wings 20 shown in FIGS. 4, 5, 15 and 16 are special for ring-wing semi-submersible platforms. In terms of shapes of cross sections, this application presents three types of ring-wings: inverted U-shaped cross section (as shown in FIGS. 1 and 3), H-shaped cross section and regular box-shaped cross section (detailed structures of the two shapes are not shown in drawings).

The advantage of the box-shaped ring wing is to increase the buoyancy of the platform during construction and wet tow, which is significant to the concrete platform with a heavy self-weight. However, its disadvantage is completed structures which is not preferred to be rotated and folded. The ring-wing 20 and the floating hull 10 have a common vertical central axis, a same bottom plane and annular radial gap(s) 29 in between, and are connected to each other as a complete structure by multiple connecting components 60 distributed in radial directions. In terms of construction and installation, the present application proposes two kinds of ring-wings: fixed integral ring-wing 22, and segmented ring-wing comprising fixed ring-wing segment 23, tieback ring-wing segment 24, and rotatable and foldable ring-wing segment 25 (only applicable to the inverted U-shaped and H-shaped cross section of the ring-wing). The ring-wing is a steel, concrete, composite of steel and concrete, glass fiber, or composite of glass fiber and steel structure. The annulus gap 29 in radial direction between the ring-wing 20 and the floating hull 10, as well as the gap between the pillar tanks 131 and the bottom horizontal connection girders 132 have significant contributions on reducing wave loads on the floater 70 and improving seakeeping capacities of the ring-wing floating platform 1. For the ring-wing semi-submersible platform as shown in FIGS. 4 and 5, the annular gaps 29 include a big square annular gap between the ring-wing 20 and the four pillar tanks 131 or the horizontal connection girders 132, and gaps between the four pillar tanks 131 and the horizontal connection girders 132. Alternatively, for the ring-wing semi-submersible platform as shown in FIGS. 15 and 16, the annular gaps 29 include four separate annular gaps around each pillar tank 131 only. Note: Both tops of the ring-wing and the horizontal connection girders with a same plane are underwater in a depth which has little effects of waves.

The most important feature of the present application is that the ring-wing floating platform could install dry wellheads, store crude oil, produce and store LNG. As long as the floating platform could install dry wellheads and has sufficient deck area, no issues would exist regarding the installation of drilling or production facilities, LNG facilities, natural gas chemical facilities to meet required working conditions. When the ring-wing floating platform in this application is mainly used for productions and storage for oil and gas field development, with a subsidiary function of drilling, the ring-wing platform will be a floating wellhead storage offloading unit (FWSO). When the ring-wing floating platform is used for drilling as its main function, the storage capacity is a subsidiary function, the platform will be a ring-wing semi-submersible platform (RW-SEMI), or multiple cylindrical floating platform, which could be used for deep water drilling, prolonged test, and trial production. Therefore, the ring-wing platform shows excellent hydrodynamic performance, especially on heave motion response. Usually the maximum amplitude of heave motion of ±3 m is required for the one-hundred-year environmental conditions, in order to accommodate the operational requirements of dry wellhead. Three approaches are well known to improve the dynamic performance of a floater: Firstly, to minimize responses of the floater to the wave motion; secondly, to minimize the wave loads applied on the floater; thirdly, to make full use of damping from the motion response.

In order to reduce the response to the wave motion of the floater, the natural period of the floater need to stay away from the high energy density of the wave period range as far as possible. For the South China Sea and the Gulf of Mexico, the said period ranges from about 12 to 16 seconds. Similar to SPAR platform, the natural periods of the ring-wing floating platform, especially in the direction of heave, must be greater than 20 seconds. As is known to all, the square of the natural period of a floating body at a certain degree of freedom is inversely proportional to the of its stiffness at that degree of freedom, and is proportional to its total mass (floater self-mass+added mass of entrained water) or the total moment of inertia (moment of inertia of floater+moment of inertia of entrained water). The design philosophy of the SPAR platform is to reduce the heave stiffness and increase the natural frequency by adopting a small water plane area and a deep draft. Compared to SPAR platform, the ring-wing floating platform has a bigger water plane area and heave stiffness, and smaller draft. However, because of the ring-wing 20, the added mass and moment inertia of entrained water increase significantly, resulting in a natural period greater than SPAR platform. Therefore, the proposed ring-wing 20 must be large enough in three dimensions, so that the platform is able to "drive" a large enough body of water when subjected to forced movements. As described above, the present application offers ring-wings with three types of radial cross-sections: inverted U-shaped, H-shaped and rectangular. The radial width b and height h of the radial cross-section are generally greater than 15 m and 10 m, respectively.

In order to reduce the wave force directly acting on the ring wing, the ring-wing 20 in the present application is submerged in seawater. Its top is located at a depth where the wave has little effects. In the South China Sea and the Gulf of Mexico, such depth is roughly between 35 and 40 m. So the draft of the proposed ring-wing floating platform is usually greater than about 50 meters considering the bigger height of the ring-wing, which is less than SPAR platform draft of about 200 meters. In addition, wave action will diffract when acting on the floater surface above the ring-wing. Partial water particles diffract down, so as the energy transmission. Sufficient radial clearance (annular gap) 29 exists between the ring-wing 20 and the floating hull 10, which links the water body from top to the bottom of the ring-wing and can reduce significantly the above-mentioned forces acting on the top of the ring-wing (see FIG. 1). This is one of the most important features of the proposed ring-wing floating platform 1.

Another feature of the large-scale ring wing 20 and the annular gap 29 is the greatly increased potential flow damping and viscous damping. To further increase the viscous damping in heave (sway), multiple uniformly distributed circular apertures (not shown in figures) as damping orifices can be drilled on horizontal plate 251 and the outer vertical plate 252, which form the inverted U-shaped or H-shaped radial section of the proposed ring-wing (see FIG. 7)

The sizes of the gaps annular 29 between ring-wing 20 and the floating hull 10, and the height and radial width of the cross section of the ring-wing 20 must be determined by hydrodynamic calculations and model tests. Preliminary results from the hydrodynamic analyses show that setting or not setting the annular gap(s) 29 between ring-wing 20 and the floating hull 10 will directly affect the wave loads acting on the ring-wing 20 and the floating hull 10, and the wave loads on the ring-wing 20 are reduced significantly by the annular gap(s) 29. Also, the width d and height h of the cross section of the ring-wing have huge influences on the mass, damping, the moment of inertia in heave and sway, and damping arm of the entrained water. The ring-wing with sufficient height h is much better than the thin annular damper plate. Despite that the water plane area and the heave stiffness of the ring-wing platform is larger than the SPAR platform, the heave natural period of the proposed platform could be up to 26 seconds which is more than SPAR platform, and the maximum amplitude of heave motion is about ±3 m, the maximum amplitude of pitch/roll motion is far less than the SPAR platform, owing to the ring-wing and the annular gap. At the same time, because of the increased water plane area, roll under wind loads and stability of the ring-wing platforms are much better than the SPAR platform.

The positioning system 30 for the ring-wing floating platform 1 in this application is mainly a leg mooring system 31 (as shown in FIGS. 1 and 2), where the floating hull 10 is fixed to the seabed via mooring legs. For a ring-wing platform used for drilling with high frequency of relocations, and for prolonged test or trial production after drilling, the positioning systems could be a dynamic positioning system, a leg mooring system, or a combination of both.

For the ring-wing platform using the leg mooring system, fairleaders 32 of the leg mooring system are typically located around the center of buoyance of the platform, which is above the ring-wing at the bottom of the floating hull 10 (see FIG. 1). Therefore, multiple notches 26, which number is equal to the number of the legs of the mooring system, are located the inner side of the ring-wing 20 (as shown in FIGS. 2, 10, 12 and 13). The sizes of the notches should guarantee that mooring legs through the fairleads 32 would not contact or collide with the ring-wing 20 during the motions of the platform.

The ring-wing, as a large-scale underwater object, has a great impact on the platform construction and towing. The floating hull 10 (especially for the concrete hull) and the topsides 40 of the ring-wing platform are commonly constructed through a two-step approach of dry and wet: firstly, construction of the lower part of the hull would be completed in a dry dock. If possible, topside support legs joining hull structure and topside with partial facilities could be constructed at the same time (dry construction); secondly, the lower part of the hull and the finished structures would float out of the dock to an outfitting quay or a sheltered waters, where the rest of the floating hull and topsides construction would be completed (wet construction). Compared with the inverted U-shaped or H-shaped cross-section of the rings-wing under condition of a same dock depth and draft inside the dock, the regular box-shaped cross section of the ring-wing could provide greater buoyancy to increase the allowable weight of dry construction inside the dry dock, which means increment on the amount of dry construction work and reductions on the amount of wet construction work to reduce the project costs and shorten the construction period. Meanwhile, the regular box can be used to store liquids if necessary. The ring-wings with an inverted U-shaped or H-shaped cross-section are made of plates and beams, which do not have the advantages of the regular box. However, their structure are relatively simple. Considering all three kinds of ring-wings with same radial widths and heights, the differences regarding natural period among them are small, although the weight of the ring-wing with a regular box cross section increase after being filled with liquids. This is because the mass of entrained water caused by the ring-wing is much greater than the mass of the ring-wing itself (including the liquids mass inside the box).

Large-scale ring-wing has a great contribution on improvement of the hydrodynamic features of the proposed platform. However, the fixed integral ring-wing as shown in FIGS. 1 and 2 brings big challenges on constructions and towing: the dry dock needs to be wide enough to accommodate large-scale ring wing; during the towing process, the towing resistance increases greatly due to the large-scale submerged ring-wing. If the proposed platform needs to be relocated frequently as a drilling platform, its towage convenience needs to be carefully evaluated.

In order to overcome the above-mentioned disadvantages of the fixed integral ring-wing, the present application further provides a type of segmented ring-wing as described below, i.e. the fixed integral ring-wing is divided into several parts, or a few of segments, including: fixed ring-wing segment 23 (See FIGS. 4, 5, 12, 13, 15, 16), tieback ring-wing segment 24 (see FIGS. 10, 12), and rotatable and foldable ring-wing segment 25 which is only applies to ones with the inverted U-shaped and H-shaped cross sections (see FIG. 4,5,12,15,16). The tieback ring-wing segment comprises adjustable seawater ballast compartments. Accordingly, the ring-wing in the present application includes four types: fixed integral ring-wing 22, full tieback ring-wing, partial tieback ring-wing, and rotatable and foldable ring-wing.

Figure 10:
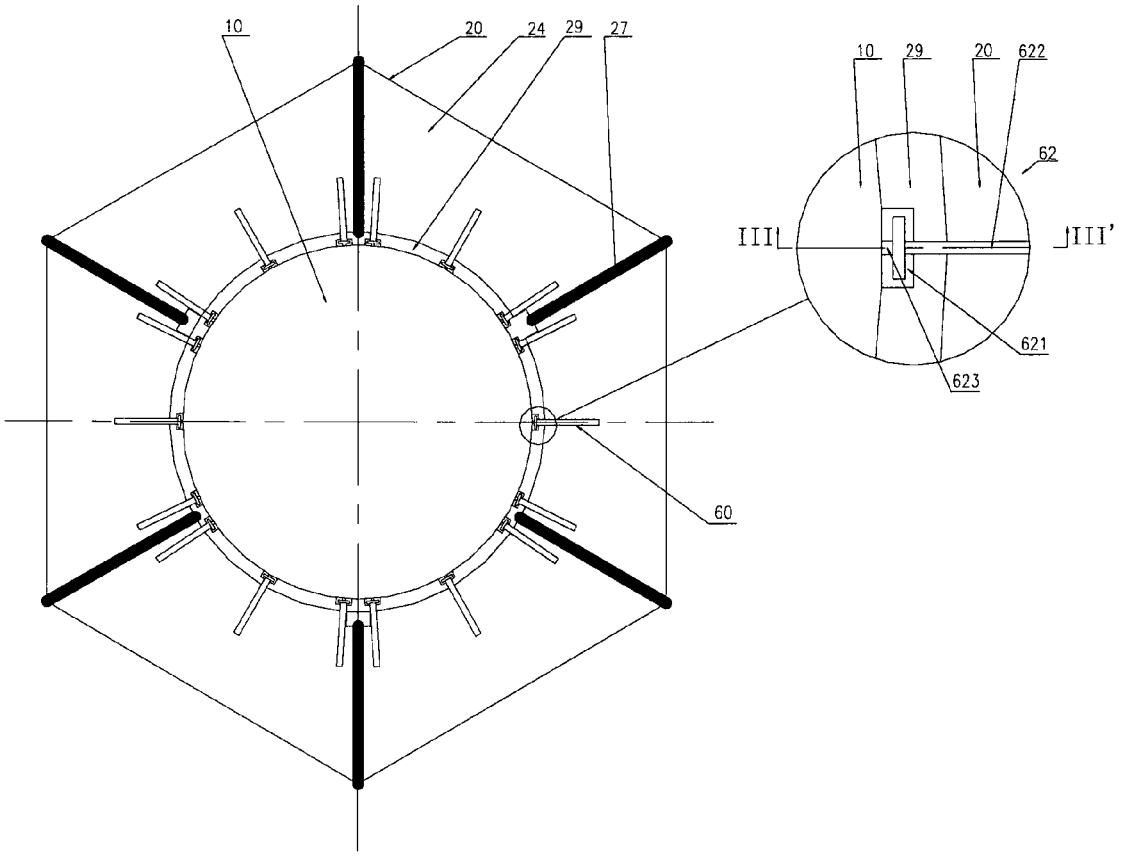
FIG. 10 is a plane view of the full tieback ring-wing.

FIG. 10 shows the full tieback ring-wing. That is, the ring-wing 20 has been cut off in the middle point of notches 26, or in the middle point of the two adjacent notches 26 to form multiple segmented ring-wings (six segments just as example shown in FIG. 10). Connection seams are located at the cut-off places (indicated by thick solid line shown in FIG. 10).

Figure 12:
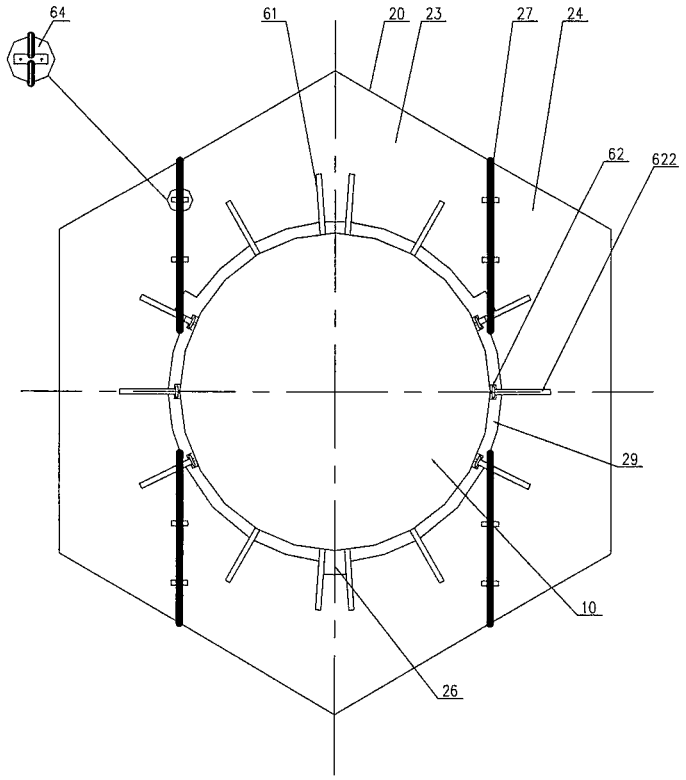
FIG. 12 is a plane view of the partial tieback ring-wing.

FIG. 12 shows the partial tieback ring-wing. That is, the ring-wing 20 on both sides of the floating hull 10 is divided by two lines, which are parallel to the fore and aft centerline of the platform. This introduces two connection seams 27 and four segments: two segments are the fixed ring-wing segments 23 at fore and aft of the platform, the other two are the tieback ring-wing segments at both sides of the hull.

Figure 13:
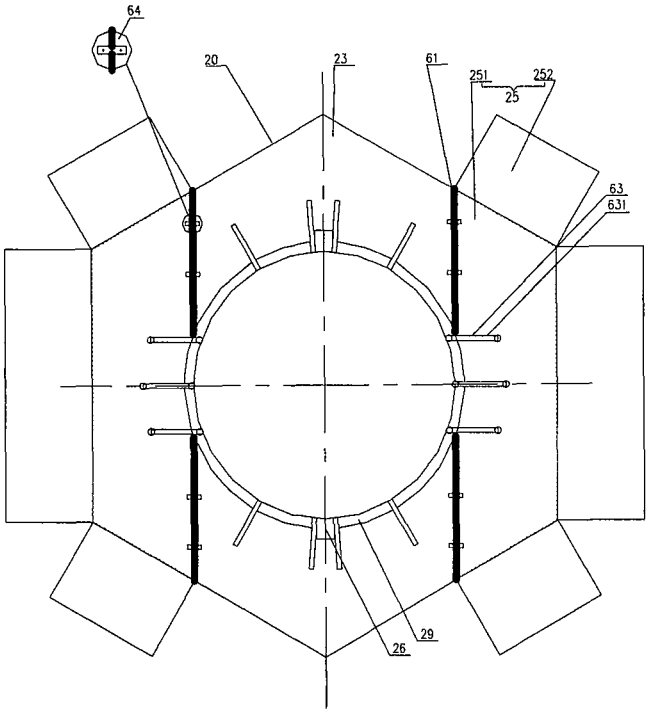
FIG. 13 is a plane view of an unfolded plane of the rotatable and foldable ring-wing in in-place condition.
Figure 14:
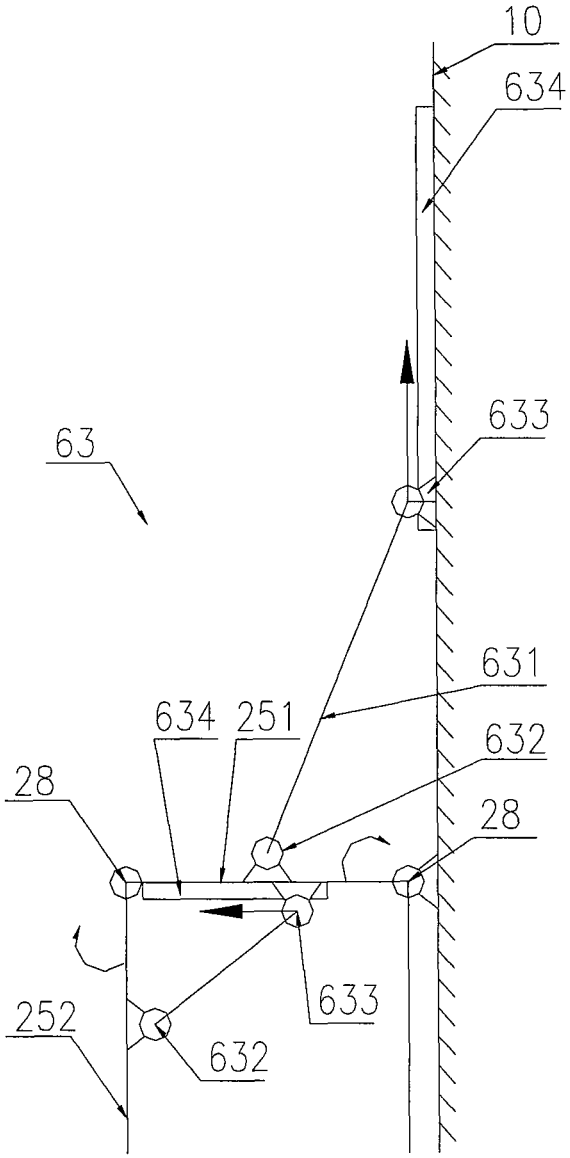
FIG. 14 is a schematic diagram of the articulated connection of rotatable and foldable ring-wing.

FIGS. 4, 5, 13, 15 and 16 show the rotatable and foldable wing-ring 25. That is, the ring-wing on both sides of the floating hull 10 is divided by two lines, which are parallel to the fore and aft centerline of the platform. This introduces two connection seams 27 and four segments: two segments are the fixed ring-wing segments 23 at fore and aft of the platform, the other two are the rotatable and foldable ring-wing segments at both sides of floating hull 25. As shown in FIGS. 13 and 14, the horizontal plate 251 and vertical plates 252 of the foldable segment, and the horizontal plate 251 of the foldable segment and the horizontal plate of the fixed segment are connected by hinge connections 28 respectively (note, the hinge 28 is overlapped with the seam 27 represented by the thick solid line in FIGS. 4, 5, 13, 15 & 16). This enable the outer vertical plates 252 of the foldable segment to rotate until the angle between itself and the horizontal plate 251 decreases from 90° to near 0°. After that, the horizontal plate 251 with the folded vertical plates 252 then could rotate up to 90° and be fixed.

The fixed integral ring-wing, the full tieback ring-wing, the partial tieback ring-wing and the rotatable and foldable ring-wing are applicable to the platforms with floating single-cylindrical-tank or with floating closely connected multi-cylindrical-tank, whereas the platform with floating interval-connected multi-cylindrical-tank can only match the rotatable and foldable ring wing.

The ring wing 20 in the present application is attached and fixed to the floating hull 10 via several connecting components 60 in radial directions, so that the two become an integral structure (see FIGS. 1 and 3). Specifically, the fixed integral ring-wing 22 (see FIG. 2) and the fixed ring-wing segments 23 (see FIGS. 4, 5, 12 and 13) are connected to the floating hull 10 by several fixed connection brackets 61 distributed in radial directions to form an integral structure. The tieback ring wing segments 24 are joined to the floating hull 10 through at least two butt-joint mechanisms 62 to form an integral structure (see FIGS. 10, 11 and 12). Furthermore, across the connecting seams 27 between the fixed ring-wing segments 23 and the tieback ring-wing segments 24, several site-connected/bolted clamping plates 64 would be used to connect and fix the said two segments (see FIG. 12). The rotatable and foldable ring-wing segments 25 are attached to the floating hull 10 and function via at least two rotatable and foldable mechanisms 63. Furthermore, across the connecting seams 27 between the fixed ring-wing segments 23 and the rotatable and foldable ring-wing segments 24, several site-connected/bolted clamping plates 64 would be used to connect and fix the said two segments (see FIGS. 4, 5, 13).

Figure 11:
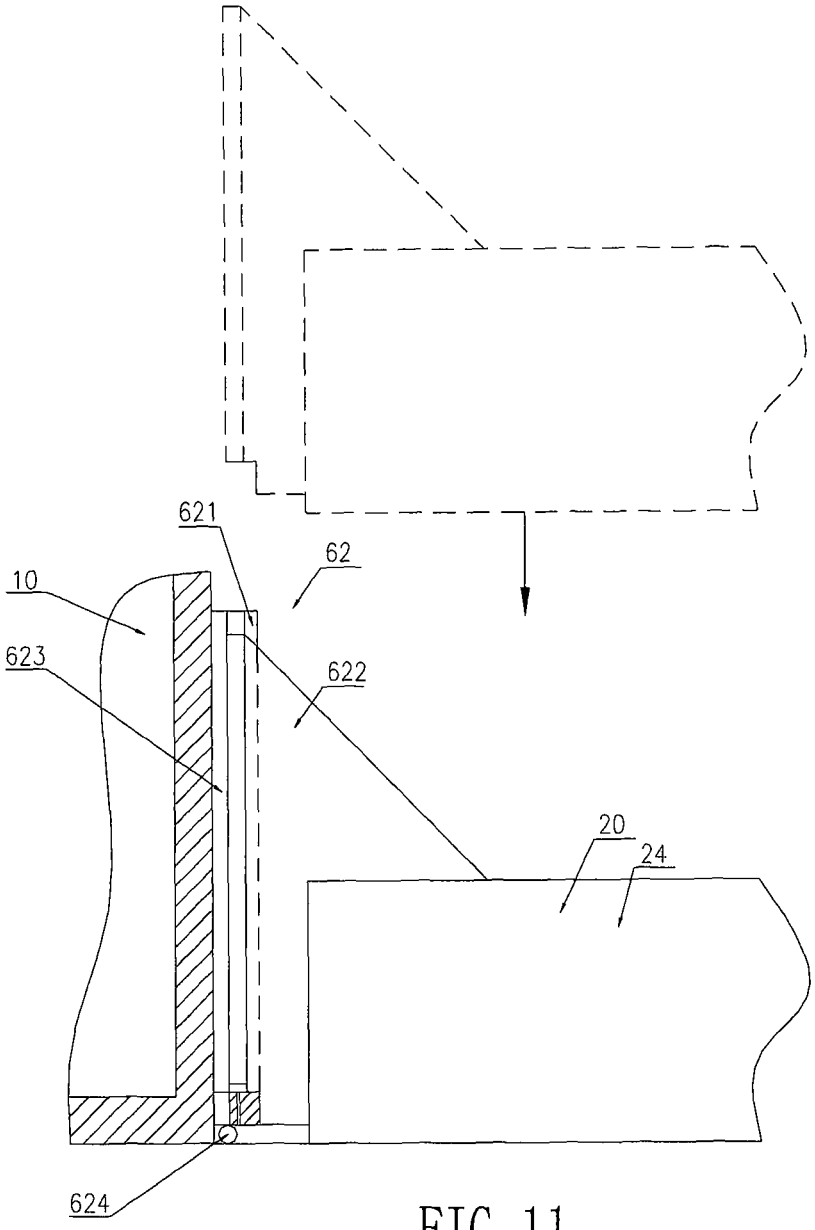
FIG. 11 is a sectional view of C-C axis from FIG. 10 (assembly connection diagram of a tieback ring wing segment)

FIGS. 10 & 11 show a design option of the butt-joint mechanism for offshore docking and installation, fastening of the tieback ring-wing segments 24 and the floating hull 10 (hereinafter referred to as "butt joint mechanism 62"). The butt-joint mechanism 62 includes: a vertical connection slot fixed on the floating hull 10, such as a T-shaped sliding slot 621 with a hole-baseplate at the bottom; a long hole for guide rope (guide hole 623 for short), which is located in-between the floating hull 10 and the vertical connection slot 621; a guide pulley 624, which is located at the bottom of the vertical connection slot 621; an installation (not showing the drawing) tieback winch (not shown in figures), which is installed above the guide hole 623; a tieback rope (not shown), which from the tieback winch goes downward through the guide hole 623 and the pulley 624 at the bottom, and then U-turn and vertically upward through the hole on the baseplate of the vertical connection slot 621, and finally returns to the hull top then being temporarily fixed; additionally, a T-shaped sliding bracket 622, wherein one side of the bracket is fixed to the segment 24, and the other side is inserted from the top into the vertical connection slot 621, and the bracket 622 could move downward to the baseplate of the slot; several locking block (not shown in figures) which can be used to fix the T-shaped sliding bracket 622 on the T-shaped sliding slot 621. Each site-installed tieback ring-wing segments 24 are attached to the floating hull 10 via at least two above described mechanism 62.

As shown in FIG. 11, the procedures of offshore docking, installation, connection and locking for the tieback ring-wing segments 24 and the floating hull 10 are following: the floating platform and the tieback ring-wing segments 24 would be hauled to the offshore site separately and the tieback ring-wing segments 24 would be floating in the vicinity of docking sites; untie the tieback rope being temporarily fixed on the floating hull 10, and connect and fix the rope to the bottom of the T-shaped sliding brackets 622; mobilize the floating ring-wing segments 24 and start the tieback winch to pull the tieback rope, lead the vertical T-shaped sliding bracket 622 to locate right above the T-shaped sliding slot 621, as dash lines shown in FIG. 11; pull the tieback rope further, meanwhile, seawater would be injected into the ballast tanks inside the tieback ring-wing segment 24 to make the ring-wing segment sink slowly (follow the direction indicated by the arrow in FIG. 11) and inserted into the vertical connection slots 621 until it contacts the baseplate of the slot (note: injected ballast seawater needs to make the submerged weight of the ring-wing segment slightly greater than its displacement); fix the locking blocks, and attach the T-shaped sliding bracket 622 to the vertical T-shaped sliding slot 621, complete offshore installation between the tieback ring-wing segment 24 and the floating hull 10.

FIG. 14 shows a design option of the rotatable and foldable mechanism 63 for the rotatable and foldable ring-wing segment 25 to be connected to the floating hull 10, i.e., a set of sliding hinge link mechanism to achieve the rotation, folding and reset. The mechanism 63 includes: a sliding slot 634, which is fixed on the floating hull 10 or the lower surface of the horizontal plate 251 of the rotatable and foldable ring-wing segment; a fixed hinge bearing 632, which is fixed on the top surface of the horizontal plate 251 of the segment 25 or the inner surface of the outer vertical plate 252; a sliding hinge bearing 633 which is installed inside the said sliding slot 634, and could slide up and down or along the radial directions; an articulated rod 631, which both ends are attached to the fixed hinge bearing 632 and the sliding hinge support 633 respectively; a part that could drive the sliding hinge support 633 to slide inside the sliding slot 634, such as telescopic hydraulic cylinder, or retractable screw (not shown in figures) mounted on the extended line of the sliding slot 634. Between two adjacent hinges, the embodiment also set a number of L-shaped stopper and locking blocks (not shown in figures), which functions are: firstly, to limit the rotating angle within 90°; secondly, to lock the hinges and avoid their rotations and movements during in-place conditions, to unlock, and then temporarily fixed after rotation and folding of the plates if necessary.

Only during construction and wet towing phases of the proposed floating platform, the rotatable and foldable segments need to be rotated and folded, so as to reduce the width of the platform to improve maneuverability of the towing. Procedures from in-place (as shown in FIG. 14) to folded condition are: unlock, rotate outward the outer vertical plate 252 so that the angle between the horizontal plate 251 and itself is close to 180°, then fixed temporarily; rotate upward the horizontal plate 251 together with the plate 252 near to the vertical position and fixed temporarily. Procedures from folded to in-place condition are: release the temporary fixture on the outer vertical plate, rotate the outer vertical plates, then lock it, releasing temporarily fixture of the horizontal plate, rotate horizontal plate, then lock it.

The proposed ring wing floating platform can be applied very widely. It can be used for drilling, oil and gas exploration and development, prolonged tests and trial production after drilling; it can also be used for crude oil production/storage, gas production, liquefaction, storage, regasification, and oily water treatment. It is very suitable for deep water and harsh sea states.

Floating Wellhead Storage and Offloading (FWSO) and Multi-Cylinder Floating Drilling Platform.

FWSO in the present application has storage tanks with high capacities, and can be divided into two forms: single-cylinder FWSO and multi-cylinder FWSO.

The floating hull 10 of the single-cylinder FWSO in this application is a floating single-cylindrical-tank 11 as shown in FIGS. 1 and 2. It is recommended to use the fixed ring-wing or the partial tieback ring-wing this FWSO. Especially, the fixed ring-wing segments 23 and the tieback ring-wing segments 24 prefer to use an inverted U-shaped cross section. The positioning system 30 would employ the mooring leg system 31. The topsides 40 would use open deck 41 as shown in FIG. 1, which is connected to the top of the floating single-cylindrical-tank 11 through the deck legs 411. Alternatively, the topsides 40 can be installed directly on the top of the tank 11. A safety gap not less than 3.5 meters is required between them. Wave wall with ventilation capacity needs to be set from the top of the floating single-cylindrical-tank 11 to the lower deck bottom of the topsides 40. The single cylinder FWSO in this application is mainly used for oil field development and production. It can be installed not only dry wellheads and facilities for crude oil production and storage, but also drilling or work over facilities, which could replace the existing development plan of SPAR+subsea pipeline+FPSO. Compared to the existing SEVAN cylindrical FPSO, the advantages of this single-cylinder FWSO are its superior hydrodynamic performance, installation of dry wellhead, and capacity of drilling.

The floating hull 10 of the multi-cylinder FWSO in this application is a floating closely connected multi-cylindrical-tank 12, i.e., a multi-cylinder floater 70 as shown in FIGS. 6 and 7 which is formed by multiple tank units closely connected in at least one layer; wherein the tank unit is a tank unit with steel and concrete composite walls 72. It is recommended to use the fixed ring-wing 23, the partial tieback ring-wing 24 as shown in FIG. 12, or the rotatable and foldable ring-wing 25 as shown in FIG. 13. Especially, fixed ring-wing segments 23 prefers to use a rectangular box or an inverted U-shaped cross section. Because the feature of the rectangular box cross section is to increase the buoyancy of the platform, which has a significant meaning for the concrete floating platform. The tieback ring-wing segments 24, and the rotatable and foldable wing-ring segment 25 prefer to use inverted U-shaped cross section. The positioning system 30 would employ the mooring leg system 31. The topsides 40 would use the open deck 41 as shown in FIG. 1, which is connected to the top of the multi-cylinder floater 70 through the deck legs 411. Alternatively, topsides 40 can be installed directly on the top of the multi-cylinder floater 70. A safety air gap no less than 3.5 meters is required between them. Wave wall with a capacity of ventilation needs to be set from the top of the multi-cylinder floater 70 to the lower deck bottom of the topsides 40. The multi-cylinder FWSO in the application is mainly used for oil field development and production, wherein all the unit tanks 72 are suitable for storing crude oil, as shown in FIG. 8. It can be installed not only dry wellheads and facilities for crude oil production and storage, but also drilling or work over facilities, which could replace the existing development plan of SPAR+subsea pipeline+FPSO. Additionally, it can be used for gas field development and production, wherein all the tank units 72 are suitable for storing LNG, as shown in FIG. 9. It can be installed not only dry wellhead and facilities for gas production, storage and offloading of liquefied natural gas, but also drilling or work over facilities, which could replace the existing development plan of SPAR platform+FLNG which is still developing. What's more, the multi-cylinder FWSO could be used for oil field development to collect light oil and oil field associated gas, so that the platform could produce and store crude oil, LNG, LPG and condensate field oil, wherein the unit tanks could have different types as shown in FIGS. 8 and 9 and be selected as per the liquid products to be stored.

The floating hull 10 of the multi-cylinder drilling platform in this application is a floating closely connected multi-cylindrical-tank 12, i.e., a multi-cylinder floater 70 as shown in FIGS. 6 and 7 which is formed by multiple tank units closely connected in only one layer; wherein the tank unit is a tank unit with single wall 71 made of concrete structure preferably, and the tank units could be as the following one or multiple function spaces: storage compartment, seawater ballast compartment, machine/pump room, spare empty compartment, and work room. The storage compartment is used to store liquids required for drilling and well liquids produced by logging and trial production. It is recommended to use the rotatable and foldable ring-wing 25 as shown in FIG. 13. Especially, fixed ring wing-segments 23 prefers to use a rectangular box. Because the feature of the rectangular box cross section is to increase the buoyancy of the platform, which has a significant meaning for the concrete floating platform. The tieback ring-wing segments 24, and the rotatable and foldable wing-ring segment 25 prefer to use inverted U-shaped cross section. The positioning system 30 would employ the mooring leg system 31 or dynamic positioning system, or the combination of both. The topsides 40 would use the open deck 41 as shown in FIG. 1, which is connected to the top of the multi-cylinder floater 70 through the deck legs 411. Alternatively, the topsides 40 can be installed directly on the top of the multi-cylinder floater 70. A safety air gap no less than 3.5 meters is required between them. Wave wall with a capacity of ventilation needs to be set from the top of the multi-cylinder floater 70 to the lower deck bottom of the topsides 40. The differences between the multi-cylinder drilling floating platform and the multi-cylinder FWSO in the application are as follows: The FWSO has a high storage capacity and displacements, as well as a large diameter of each tank unit with steel and concrete composite walls 72, for oil and gas production with low frequency of relocation. The multi-cylinder drilling floating platform has a low storage capacity and displacements and is mainly used for drilling. Each single unit tank has a small diameter with single wall, yet the diameter of the circumscribed circle needs to be large enough to secure the stability of the platform. Due to the high frequency of relocation, it is more convenient to adopt dynamic positioning system.

The floating hull 10 of the ring-wing semi-submersible (RW SEMI) in this application is a floating interval-connected multi-cylindrical-tank 13, i.e., a four-column floater, as shown in FIGS. 3, 4, 5, 15 and 16, which comprises: four floating pillar tanks 131 and four bottom horizontal connection girder 132 at the bottom, and a watertight box deck on the top to become the main frame of the platform. Similar to the existing designs of semi-submersibles, inside each pillar tank 131, anyone or combinations of storage compartment, seawater ballast compartment, engine room, pump room, spare empty compartment and work room can be placed. The said storage compartment would be used to collect liquids needed for drilling and well liquids from logging and trail production activities. Different from the existing semi-submersible that its underwater pantoons offer most of the buoyancies in addition to its columns, whereas the ring wing semi-submersible (RW SEMI) has a deep draft without pantoon in general, which displacement is normally greater than the columns of the existing semi-submersible. Therefore, the bottom horizontal connection girders 132 could use box girder structure as well as non-box girder structure. Seawater ballast compartments and/or buoyancy compartments other than engine room, pump room and work room could be arranged inside the box girder. The pillar tanks with circle cross-section 131 as shown in FIGS. 4 and 15 prefer to be concrete structure, and accordingly, the bottom horizontal connection girders would be concrete. The pillar tanks with rectangular cross-section 131 as shown in FIGS. 5 and 16 prefer to be steel structures. The box-shaped bottom horizontal connection girders would be used if more buoyancy is needed. The rotatable and foldable ring-wing 25 as shown in FIGS. 4 and 5 would be adopted in the RW SEMI. Especially, the fixed ring-wing segments 23 prefers to use a rectangular box or a reversed U-shaped cross-section, and the box cross section is to increase the buoyancy of the platform, which has a significant meaning for the concrete floating platform. The rotatable and foldable ring-wing segments 25 would adopt an inverted U-shaped cross section. The annular gaps 29 could exist not only around each pillar tank 131 as shown in FIGS. 4, 5, 15 and 16, but also between ring-wings 20 and bottom horizontal connection girders 132 as only shown in FIGS. 4 and 5. The positioning system 30 of the RW SEMI would employ the mooring leg system 31 or dynamic positioning system, or the combination of both. The topsides 40 would use watertight box deck 42. The feature of the RW SEMI is its improved hydrodynamic performance and storage capacity and suitable for trail production after drilling; and also concrete could be used to improve its safety and reliability, and reduce the costs.

The proposed ring-wing floating platform in the application offers completely new facilities and develop plan, and meets all the requirements for developments and productions of deep water oil and gas fields. It shows multiple functions such as: drilling, oil and gas production, storage, transportation, oily water treatment, gas liquefaction and re-gasification. The whole system is eco-friendly and reliable. All the constructions and pre-commissioning can be done in a ship yard, which reduces construction cost of the facilities, operation costs and decommissioning costs.

The described specific embodiments mentioned above are only used to explain the purpose of the invention to provide a better understanding, and could not be interpreted as limitations to the invention in any way. In particular, various features in different embodiments described herein could be combined mutually and arbitrarily to form other implementation methods; unless there was a clear contrast descriptions, these features should be understood as can be applied to any embodiment, not limited to the embodiments described herein.

What is claimed is:

1. A ring-wing floating platform, comprising:

a floating hull, wherein a top of the floating hull is above a sea surface and its geometry at a water plane is centrally symmetric;

a ring-wing surrounding a perimeter of a bottom of the floating hull with a horizontal projection of concentric annular geometries, wherein the ring-wing is a segmented ring-wing, wherein one or more segments of the segmented ring-wing are one or more of: a fixed ring-wing segment, a tieback ring-wing segment, or a rotatable and foldable ring-wing segment;

a positioning system located at the bottom of the floating hull; and a topsides located above the floating hull and connected to the floating hull by deck legs or installed directly on the top of the floating hull, wherein axes of the ring-wing and the floating hull are collinear, and their bottoms are in a same horizontal plane, wherein the ring-wing and the floating hull are connected together as a unitary structure by multiple connecting components with an annular gap in-between, and wherein multiple tieback ring-wing segments form a tieback ring-wing, wherein one or more fixed ring-wing segments and one or more tieback ring-wing segments form a partial tieback ring-wing, wherein the one or more fixed ring-wing segments and one or more rotatable and foldable ring-wing segments form a rotatable and foldable ring-wing.

2. The ring-wing floating platform as described in claim 1, wherein the tieback ring-wing segment is site-docked and connected to the floating hull by a butt-joint mechanism in addition to the multiple connecting components, wherein the rotatable and foldable ring-wing segment is connected to the floating hull by a hinge connection and a rotatable and foldable mechanism.

3. The ring-wing floating platform as described in claim 1, wherein a horizontal projection of the ring-wing is a concentric annulus with an outer circle or regular polygon, and an inner circle or regular polygon.

4. The ring-wing floating platform as described in claim 1, wherein the ring-wing is constructed from one or more of: steel, concrete, reinforced concrete, fiberglass reinforced plastic, or fiberglass and steel composite structure, wherein a radial cross section of the ring-wing is a box-shaped cross section, an inverted U-shaped cross-section, or an H-shaped cross-section.

5. The ring-wing floating platform as described in claim 1, further comprising notches at an inner side of the ring-wing, wherein a number of the notches is equal to a number of mooring legs, wherein the mooring legs penetrate the notches.

6. The ring-wing floating platform as described in claim 1, wherein the floating hull comprises one or more of: a floating single-cylindrical-tank, a floating closely connected multi-cylindrical-tank, or a floating interval-connected multi-cylindrical-tank, wherein the floating hull is made of steel, concrete, or combination thereof, wherein inside spaces of the floating hull are arranged with at least one buoyancy compartment plus one ballast compartment, one storage compartment, or one storage compartment plus one seawater ballast compartment.

7. The ring-wing floating platform as described in claim 6, wherein the floating single-cylindrical-tank comprises an outer vertical shell, a middle and a central annular vertical bulkheads in a circular or a regular polygon shape from outside in, which forms at least one outer annular compartment, an middle annular compartment, and a center compartment with multiple vertical bulkheads along a radial direction.

8. The ring-wing floating platform as described in claim 7, wherein the center compartment is a pump room, a machine room, or a penetrative moon pool, wherein the annular middle compartment is a storage compartment, wherein the outer annular compartment is a seawater ballast compartment or a seawater ballast compartment with a solid ballast compartment.

9. The ring-wing floating platform as described in claim 7, wherein the ring-wing floating platform is a single-cylinder floating wellhead storage offloading platform, wherein its floating hull is the floating single-cylindrical-tank with a fixed ring-wing, or a partial tieback ring-wing, wherein a cross section of its ring-wing is inverted U-shaped.

10. The ring-wing floating platform as described in claim 6, wherein the floating closely connected multi-cylindrical-tank is formed by a main body and two associated connection structures at its bottom and top, wherein the main body comprises multiple tank units being closely arranged in concentric circles with one or more layers to form a honeycomb naming a multi-cylinder tank group, wherein a top and bottom of outer walls of the main body are extended outward to form a top connection structure and a bottom connection structure separately, wherein the top connection structure or the bottom connection structure is a flat cylinder with a diameter equal to a diameter of a circumscribed circle projected by an outer layer of the tank units.

11. The ring-wing floating platform as described in claim 10, wherein a top of a bottom flat cylinder protuberates up and down respectively along a vertical direction to form two conical surfaces, each conical surface reaching and linking with outer tank units of the multi-cylinder tank group to produce intersecting lines.

12. The ring-wing floating platform as described in claim 10, wherein the tank units within the multi-cylinder tank group are single wall vessels which serve as one or more of: a storage compartment, a seawater ballast compartment, an engine room, a pump room, a spare empty tank, or a work room.

13. The ring-wing floating platform as described in claim 10, wherein the tank unit is a tank unit with steel plate and concrete composite walls comprising:

a cylindrical outer concrete tank, including an outer tank shell;

a cylindrical inner steel tank, including an inner tank shell; and a gap between the outer tank shell and the inner tank shell, wherein the gap forms one or more of: an isolation layer filled with an isolated medium or a spare compartment.

14. The ring-wing floating platform as described in claim 13, wherein the cylindrical inner steel tank is a liquid storage compartment with a single wall or a multi-wall located at an upper position inside the cylindrical outer concrete tank or at a middle position, wherein the isolation layer is filled with a nitrogen, wherein the spare compartment between the cylindrical inner steel tank and the cylindrical outer concrete tank is a seawater ballast compartment.

15. The ring-wing floating platform as described in claim 10, wherein the ring-wing floating platform is a multi-cylinder floating wellhead storage offloading platform with a fixed ring-wing, a partial tieback ring-wing, or a rotatable and foldable ring-wing, wherein a cross section of the fixed ring-wing segment is box-shaped or inverted U-shaped, wherein the tieback ring-wing segment and the rotatable and foldable ring-wing segment are inverted U-shaped.

16. The ring-wing floating platform as described in claim 10, wherein the ring-wing floating platform is a multi-cylinder drilling platform, wherein the floating closely connected multi-cylindrical-tank is a concrete structure with a rotatable and foldable ring-wing, wherein a cross section of the fixed ring-wing segment is box-shaped or inverted U-shaped.

17. The ring-wing floating platform as described in claim 6, wherein the floating interval-connected multi-cylindrical-tank is a four-column floater, wherein the four-column floater includes four floating pillar tanks and four horizontal connection girders, wherein a cross section of each pillar tank is a circle or a rectangle, wherein bottoms of the horizontal connection girders and the floating pillar tanks are in a same plane, wherein each horizontal connection girder connects to the bottoms of two adjacent floating pillar tanks through multiple fixed connection brackets with a gap in-between as a water channel.

18. The ring-wing floating platform as described in claim 17, wherein the floating pillar tanks are made of concrete or steel, and the horizontal connection girders and the fixed connection brackets are concrete structures or steel structures, wherein the floating pillar tank includes one or more of: a storage compartment, a seawater ballast compartment, an engine room, a pump room, a spare empty compartment, or a work room.

19. The ring-wing floating platform as described in claim 17, wherein the ring-wing floating platform is a ring-wing semi-submersible platform with a rotatable and foldable ring-wing, wherein a cross section of the fixed ring-wing segment is box-shaped or inverted U-shaped, wherein a cross section of the rotatable and foldable ring-wing segment is inverted U-shaped, wherein annular gaps are surrounding each pillar tank.

* * * * *